US012661599B2

(12) United States Patent
Mosner

(10) Patent No.: US 12,661,599 B2
(45) Date of Patent: Jun. 23, 2026

(54) INTERACTIVE ELECTRONIC HANDHELD TOY FOR PLAY

(71) Applicant: Ethan Aaron Mosner, Oxford, NY (US)

(72) Inventor: Ethan Aaron Mosner, Oxford, NY (US)

( * ) Notice: Subject to any disclaimer, the term of this patent is extended or adjusted under 35 U.S.C. 154(b) by 316 days.

(21) Appl. No.: 18/143,510

(22) Filed: May 4, 2023

(65) Prior Publication Data

US 2023/0356102 A1 Nov. 9, 2023

Related U.S. Application Data

(60) Provisional application No. 63/454,509, filed on Mar. 24, 2023, provisional application No. 63/338,663, filed on May 5, 2022.

(51) Int. Cl.
*A63H 33/26* (2006.01)

(52) U.S. Cl.
CPC ..... *A63H 33/26* (2013.01)

(58) Field of Classification Search
CPC ..... A63H 33/26
USPC ..... 362/219; 446/85–128
See application file for complete search history.

(56) References Cited

U.S. PATENT DOCUMENTS 3,755,663 A * 8/1973 George, Jr. ..... G09F 13/28 362/249.14
3,911,264 A * 10/1975 Chao ..... F21V 33/008 D21/457
4,006,556 A * 2/1977 Williams ..... A63B 19/00 446/242
4,207,087 A 6/1980 Morrison et al.
4,480,831 A * 11/1984 Muller-Deinhardt ..... A63B 21/0608 446/236
4,509,929 A * 4/1985 Zawitz ..... A63H 33/065 D11/18
4,915,666 A * 4/1990 Maleyko ..... A63B 19/00 446/490
5,108,340 A * 4/1992 Farrow ..... A63B 19/00 446/28
5,110,315 A * 5/1992 Zawitz ..... A47B 65/00 446/121
5,145,443 A * 9/1992 Vaisnys ..... A63H 5/00 446/265
5,300,921 A * 4/1994 Hoch ..... A61B 5/1071 473/464
5,934,792 A * 8/1999 Camarota ..... F21V 21/005 362/240
6,086,478 A 7/2000 Klitsner et al.
6,165,040 A * 12/2000 Burich ..... A63B 19/00 446/397
6,210,278 B1 4/2001 Klitsner
6,497,603 B1 * 12/2002 Magers ..... A63B 19/00 446/236
6,848,992 B2 2/2005 Adams
7,229,182 B2 * 6/2007 Schrader ..... F21V 33/008 362/108

(Continued)

*Primary Examiner* — Michael D Dennis
*Assistant Examiner* — Matthew B Stanczak
(74) *Attorney, Agent, or Firm* — COOLEY LLP

(57) ABSTRACT

The present disclosure relates to a toy for handheld physical interactive play by a participant. More particularly, the disclosure relates to a toy that players physically interact with by pulling, flipping, spinning, or other movement in their hands.

20 Claims, 26 Drawing Sheets

(56) References Cited

U.S. PATENT DOCUMENTS 7,524,082 B2 * 4/2009 North ..... G02B 6/562 362/391
7,559,822 B2 * 7/2009 Byers ..... A63H 17/26 477/109
7,601,045 B2 * 10/2009 Zawitz ..... A63H 33/00 446/121
8,388,172 B2 * 3/2013 Yue ..... F21K 9/272 362/249.02
8,454,193 B2 * 6/2013 Simon ..... F21K 9/27 362/221
8,596,813 B2 * 12/2013 Ivey ..... F21K 9/27 361/752
9,393,501 B2 * 7/2016 Sze ..... A63H 33/101
10,161,568 B2 * 12/2018 Amrine, Jr ..... F21K 9/66
10,551,046 B1 * 2/2020 Tang ..... H01R 33/06
11,255,521 B1 * 2/2022 McCane ..... F21V 7/0008
11,287,291 B1 * 3/2022 Cardwell ..... G01M 17/007
2005/0255787 A1 * 11/2005 Pak ..... A63B 19/00 446/236
2006/0014468 A1 * 1/2006 Zawitz ..... A61N 1/18 446/166
2008/0009225 A1 * 1/2008 Barthold ..... A63H 33/26 73/379.03
2009/0156092 A1 * 6/2009 Zawitz ..... A63B 43/06 446/438
2012/0272921 A1 * 11/2012 Santarsiero ..... A01K 15/025 119/707
2012/0322343 A1 * 12/2012 Fogarty ..... A63H 33/26 446/485
2013/0217295 A1 * 8/2013 Karunaratne ..... A63H 30/04 446/124
2013/0225037 A1 * 8/2013 Deluz ..... A63B 19/00 446/242
2015/0202542 A1 * 7/2015 Sze ..... A63H 33/062 446/90
2015/0345755 A1 * 12/2015 Purdy ..... F21K 9/275 362/219
2016/0084482 A1 * 3/2016 Speer ..... F21K 9/275 362/222
2017/0288976 A1 * 10/2017 Wang ..... G06F 3/0486
2018/0056202 A1 * 3/2018 Michael ..... A63H 33/22
2022/0322853 A1 * 10/2022 Martin ..... A63H 5/00
2023/0356102 A1 * 11/2023 Mosner ..... A63H 3/28

* cited by examiner 3
2

1
3

2
7
6
1
4
5
2
Wiring
3
26
2

INTERACTIVE ELECTRONIC HANDHELD TOY FOR PLAY

CROSS-REFERENCE TO RELATED APPLICATIONS

The present application claims the benefit of U.S. Provisional Patent Applications No. 63/338,663 filed May 5, 2022 and No. 63/454,509, filed Mar. 24, 2023, each of which is incorporated herein by reference in its entirety.

FIELD

The present disclosure relates to a toy for handheld physical interactive play by a participant. More particularly, the disclosure relates to a toy that players must physically interact with by pulling, flipping, spinning, or other movement in their hands.

BACKGROUND

Electronic toys and games have been a major facet of the toy and game industry for many years. This includes electronic games and toys with moving parts, lights that blink, flash, etc., and sounds for representing actions, or personifications of the toy. Electronic toys and games often bring an interactive element to toys/games that otherwise would not exist, giving game play a vast opportunity for new experiences.

In the past, simple components have allowed mainly for designs where players do not interact with the electronic components, such as action figures or dolls. In such examples, a player will press a button and a segment of the figure will light up. Or a player will "feed" a doll and it will make a reactive sound. However, these electronic components do not integrate a method for gameplay with an objective and scoring system.

Recently, some toys and games have been designed where players follow a given objective. Through physically interactive electronic lights, sounds or a combination of the two and follow a set of rules and guidelines. These guidelines give the player an objective to follow. This objective will give, once followed, a score that ranks the player(s) and gives them a new goal to reach. However, these toys and games often either only have one electronic interactive component or have multiple electronic components but lack a physical aspect to the game play beyond activating a button.

Some toys have no electronic component but are extremely physical and rely solely on their tactile components. These toys are useful for engaging the player physically but do not give the player an objective. Players can mush, pull, stretch, twist, create, peel, etc., but have no score to give them new goals to reach.

Some toys have used this tactile concept but institute it into a form that only allows for one objective. These toys are usually meant to be stress relieving toys. Players will spin, flick, squeeze, press, pop, etc. These toys prevent the player from having any creativity but gives them an objective without a score. This leaves players without a goal to look to achieving And there is no practical purpose towards the toy's gameplay.

Some toys and games contain physical interactive electronic lights and sounds that are involved in the objective of the game play. These toys give the user something physically interactive, visually engaging, and an auditory stimulus that is used to play the game. However, most of the time these are not portable games that can be played almost anywhere and are usually large and bulky, or meant for outdoor use only.

Therefore, a need exists for a physically tactile appealing electronic toy with interactive lights and sounds that can be played almost anywhere. A further need exists for that toy to be handheld and gives the player and objective to strive for. This gameplay will give the user a goal to reach at the end of each play session. A need exists for a toy with a combination of materials that gives the user a multi-sensory experience. A toy that can be held, but simultaneously spun, flipped, stretched, squeezed, twisted, pulled, mushed, uses creativity etc. This need allows the user to think, be creative, but have an objective and goal to attain while following certain guidelines and rules.

SUMMARY

One or more embodiments described herein relate to a novel toy and gameplay process. Throughout the descriptions herein the user of the toy will be described as players or users but are intended to be the same. The toy uses lights, sounds, and several different materials, in a physical way of play incorporated into a particular set of play options. In some embodiments, the toy has a Torus shape. In some embodiments, the diameter of the Torus shape is about 8 inches, with the center Gap being about 4 inches, and the outer tubes on the side being about 2 inches in diameter, respectively. This shape may be split, for example, into three, four, five or six approximately equal-sized portions, hence fourth called outer tubes, that when connected form the toy's Torus shape. In some embodiments, the six outer tubes each have a clear section on both ends. These clear ends may be, for example, transparent, colorless or colored transparent (e.g., translucent), and lights may emit through the material and are visible to the user. In some embodiments, the outer tubes are connected by a rubbery stretchy, elastic material. This rubbery stretchy material may be transparent, colorless or colored transparent (e.g., translucent), and lights may emit through the material. These components are incorporated into the game play in such a way that users chase the lights around the wheel and pull or stretch the rubber connected outer tubes, (herein called joints) apart to shut the lights off before the next light becomes activated. With each light that is shut off, next light in another joint will light up slightly faster. Eventually, the joints will light up with such speed that the user will not be able to keep up and multiple joints will begin to light up around the toy at once. In this mode of play, players attempt to avoid elimination for as long as possible. Once five of the six joints are lit the player loses in this mode. This will be the original mode for the game of the toy.

BRIEF DESCRIPTION OF THE DRAWINGS

Some embodiments of the present invention are illustrated as an example and are not limited by the figures of the accompanying drawings, in which like references may indicate similar elements, shapes, designs, or modes.

FIG. 3*a* illustrates a perspective view of the outside of the female half of the outer tube according to various embodiments. FIG. 3*b* illustrates a perspective view of the inside of the female half of the outer tube without the translucent and cap according to various embodiments.

FIG. 4-FIG. 4 depicts three prospective views of the translucent end caps of the outer tube for the electronic toy according to various embodiments.

FIG. 5-FIG. 5 depicts two different perspectives of an example of the male half of the outer tube without translucent end caps. FIG. 5*a* illustrates a perspective view of the outside of the male half of the outer tube according to various embodiments.

DETAILED DESCRIPTION

Figure 1:
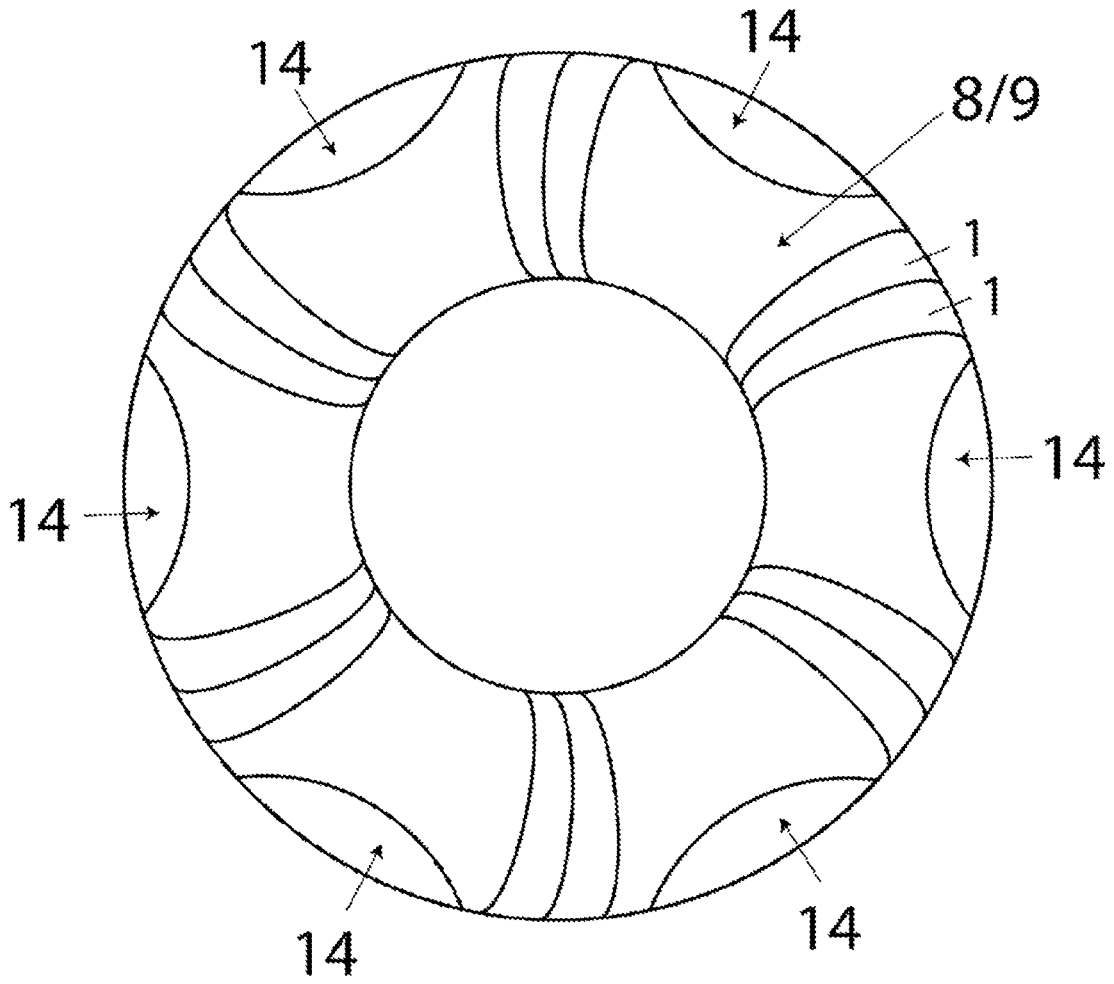
FIG. 1-FIG. 1 illustrates a perspective view of one example of the electronic toy device according to various embodiments.

The terminology used herein is for the purpose of describing particular embodiments only and is not intended to be limiting. As used herein, the term "and/or" includes any and all combinations of one or more of the associated listed items. As used herein, the singular forms "a", "an" and "the" are intended to include the plural forms as well as the singular forms, unless the context clearly indicates otherwise. It will be further understood that the terms "comprises" and/or "comprising," when used in this specification specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art. It will be further understood that terms, such as those define and commonly used dictionaries, should be interpreted as having a meaning that is consistent with their meaning in the context of the relevant art and the present disclosure and will not be interpreted in an idealized or overly formal sense unless expressly so defined herein.

In describing the toy, it will be understood that a number of techniques and steps are disclosed. Each of these has individual benefits and each can also be used in conjunction with one or more, or in some cases all, of the other disclosed techniques. According, for the sake of clarity, this description will refrain from repeating every possible combination of the individual steps in an unnecessary fashion. Nevertheless, the specification and claims should be read with the understanding that such combinations are entirely within the scope of the disclosure.

New toys, playthings, games, and game mechanics for an evolving style of play is discussed herein. In the following descriptions, for purposes of explanation, numerous specific details are set forth to provide a thorough understanding of the toy. It will be evident, however, to one skilled in the art that the disclosure may be practiced without the specific details.

The present disclosure is to be considered as an exemplification and is not intended to be limited to the specific embodiments illustrated by the figures or description below.

Apparatus for Game Play

In one aspect, provided herein is an apparatus, comprising a hand held toy having a continuous inner tube and outer tubes, arranged in a continuous closed loop around the continuous inner tube and connected by joints. Each joint may comprise or consist of at least two end caps. In some embodiments, the apparatus comprises at least two outer tubes. In some embodiments, the apparatus comprises at least three outer tubes. In some embodiments, the apparatus comprises at least four outer tubes. In some embodiments, the apparatus comprises at least five outer tubes. In some embodiments, the apparatus comprises at least six outer tubes.

The outer tubes may have any suitable shape. In some embodiments, all of the outer tubes have the same shape. In some embodiments, the apparatus comprises two types of outer tubes, such as the pin body tubes and socket body tubes described herein that fit into each other. It will be appreciated by a person of skill in the art that the outer tubes may have any shape and size that allows for the formation of the closed loop, for the containment of the switches, light sources and wires as described herein, and for the manipulation of the toy as described herein (in particular, for the stretching of the joint between two outer tubes).

The other tubes may be made of any suitable material. For example, a suitable material is one that allows for the user of the toy to hold two outer tubes and pull them apart, stretching the end cap between them. An example of a suitable material for the outer tubes include a plastic such as a hard plastic, a silicone, a rubber and/or the like.

Each two of the outer tubes can be connected by a joint made up of two end caps. The end caps may be made of a translucent elastic material, and each joint may contain a light source. The light source for a given joint can be formed from multiple light sources, e.g., each end cap can contain a light source(s) such that the combination of the light sources in the end caps collectively provides one overall light source for the joint. The continuous inner tube may contain electrical wiring that, for each of end cap, connects a sensor to the light source for that end cap. The sensor may be activated by the joint being stretched due to the two outer tubes adjacent to the end cap being pulled apart. The size of the end caps should be large enough to contain the light sources and the wiring connecting the light sources to the sensor, but may vary. Any translucent elastic material may be used to make the end caps, as long as the material allows for the joint to be stretched and the light of the light source to be seen though the material.

The continuous closed loop may have any shape that allows for the outer tubes to be pulled apart. In some aspects, the outer tubes are arranged in a substantially torus shape. The torus shape of the toy may have a diameter of about 4-10 inches, about 6-8 inches, about 4-6 inches or about 8-10 inches. In preferred embodiments, the toy has a torus shape with a diameter of about 8 inches.

Any of the components of the toy may be produced by 3D printing or any other suitable method.

Figure 10:
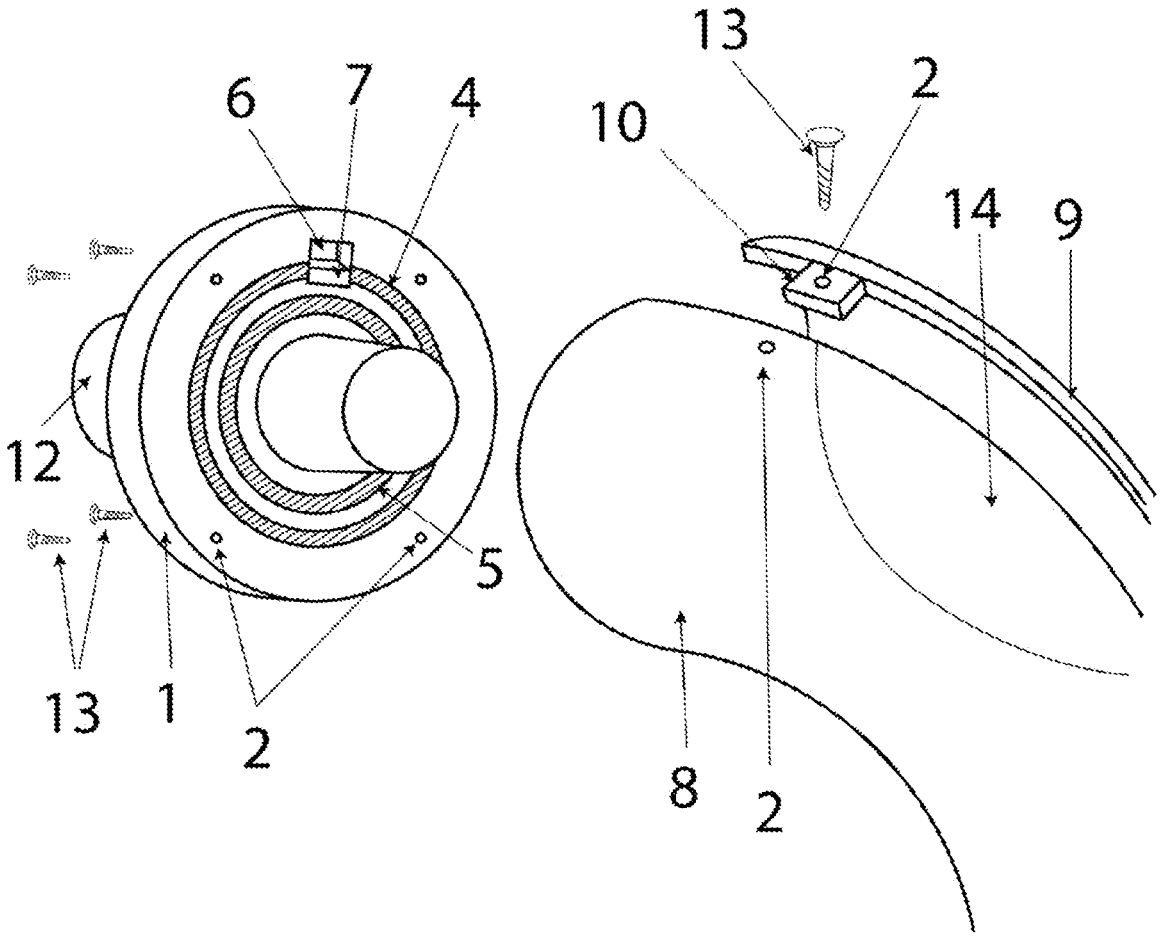
FIG. 10-FIG. 10 depicts an exploded perspective view from the back of one example of the toy with connecting material according to various embodiments.

The toy will now be described by referencing the appended figures. FIG. 10 depicts an exploded perspective view of the elements of an electronic toy (the "toy") according to various embodiments of the present disclosure. In some embodiments, each end cap(s) of the device is configured with at least four fastener apertures 2, which is configured to accept a threaded spindle 13. And in some embodiments, each half of the elements pertaining to the body, herein referred to as the outer tube, will be configured with at least three fastener apertures 2, two on top and one on the bottom which is configured to accept a threaded spindle. In some embodiments the male half of the outer tube 9, has a protruding stabilizing and placement protrusion in which fixes itself into the female half of the outer tube 8.

Figure 8:
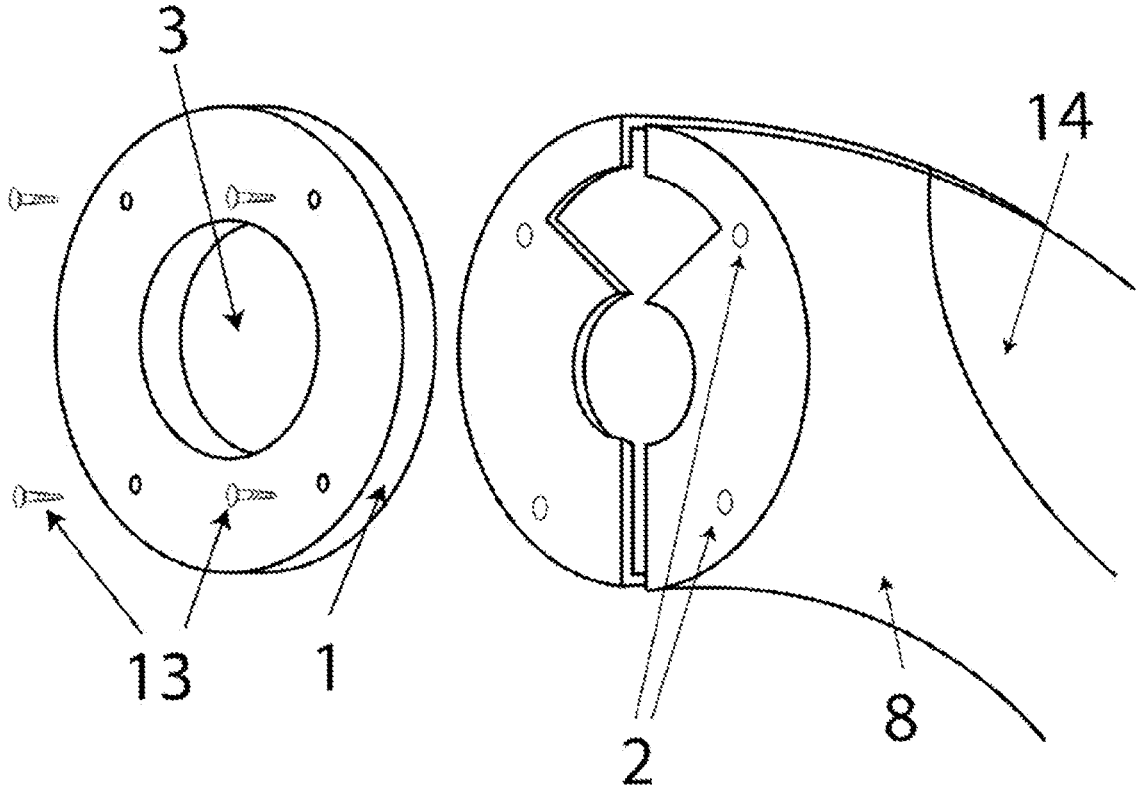
FIG. 8-FIG. 8 depicts an exploded perspective view from the front of one example of the toy according to two various embodiments.
Figure 9:
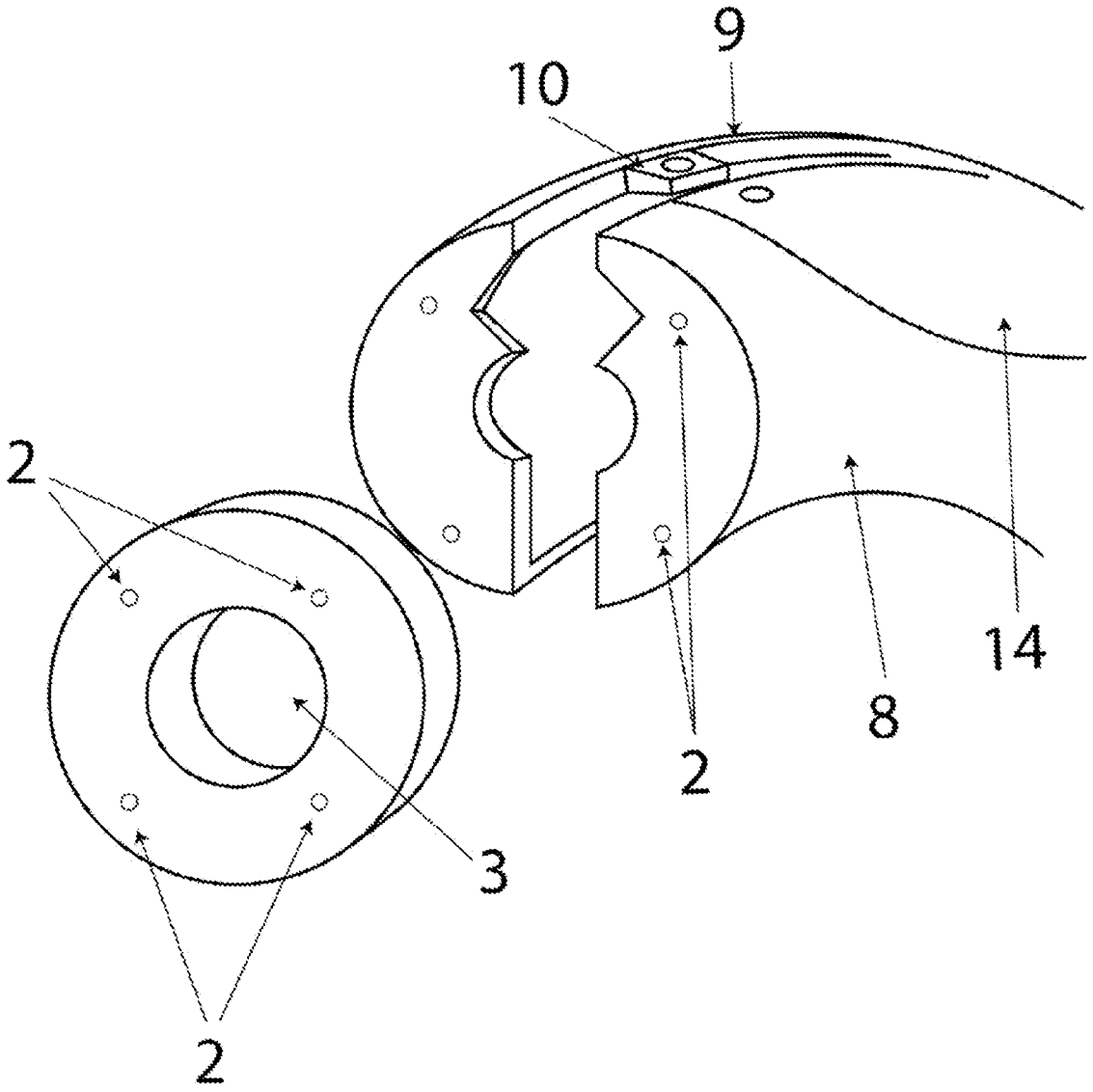
FIG. 9-FIG. 9 illustrates and exploded perspective view from the top front of one example of the toy according to various embodiments.

The outer tube 8/9 material can, for example, be a plastic of Acrylonitrile-butadiene-styrene, acrylic, polylactic acid, or any other suitable hard plastic. Once the two halves are in place and the fastener apertures are aligned the configuration will accept the threaded spindles. Once both halves of the outer tube 8/9 have been assembled the flat ends of the tube 11 ("faces") seen in FIG. 8, which is configured to accept a threaded spindle 13. In some embodiments, each half of the face will be configured with two fastener apertures. The face, when whole, will have four fastener apertures 2. The four fastener apertures on the face 2 and the four fastener apertures 2 of the end caps 1 will align in a configuration to accept a threaded spindle 13.

Figure 2:
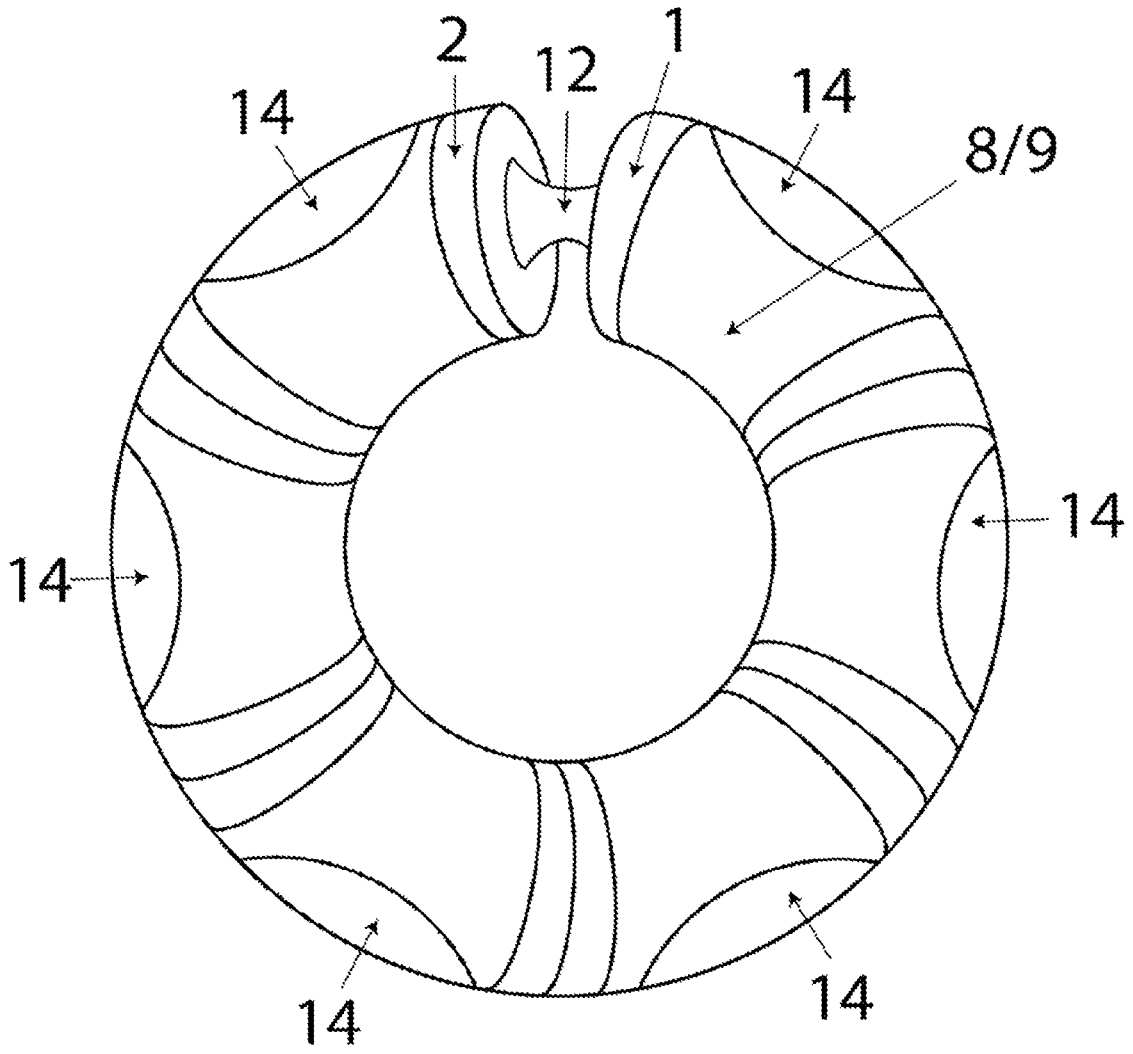
FIG. 2-FIG. 2 illustrates a perspective view of one example of the electronic toy device in action according to various embodiments.
Figure 3:
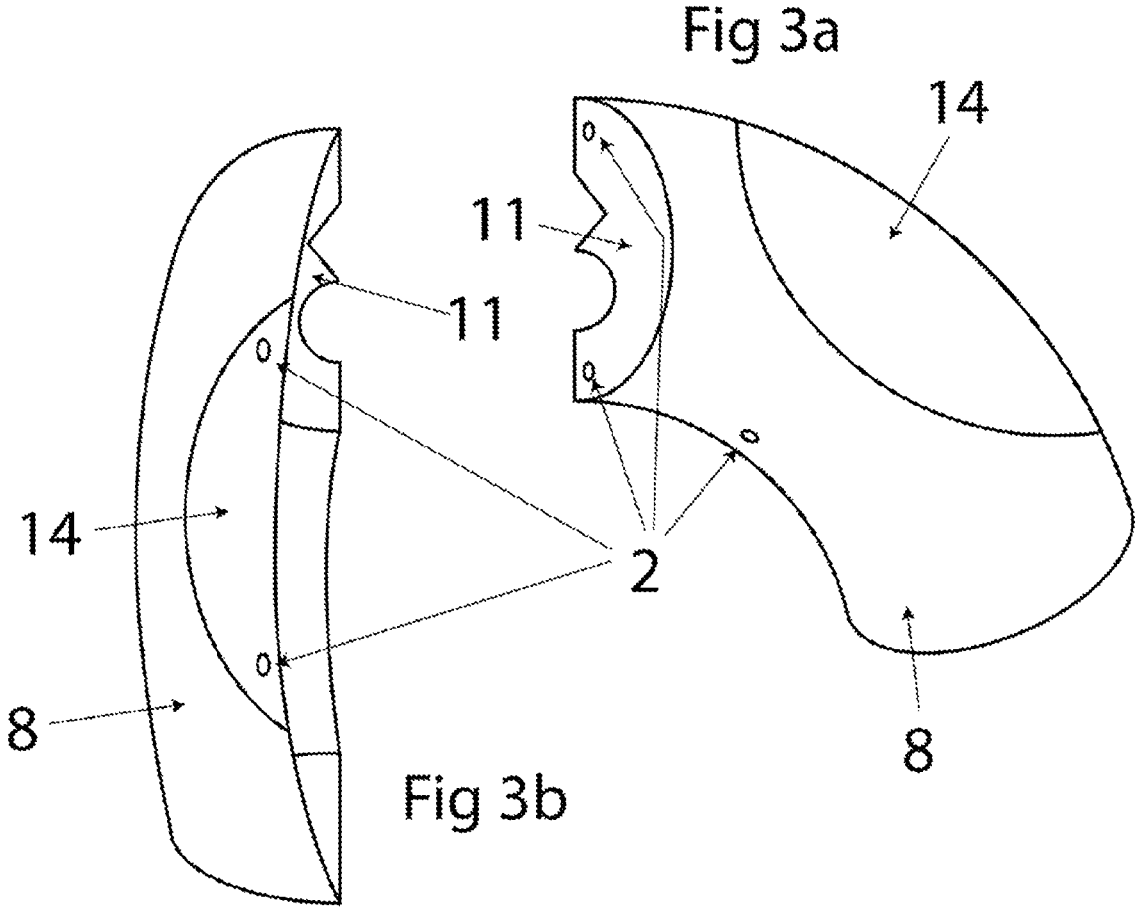
FIG. 3-FIG. 3 depicts two different perspectives of an example of the female half of the tube without the translucent end cap.

The end caps may be made of any suitable material. For example, the end caps can be made out of a translucent elastic material. In some embodiments, each of the joints has a different color. For example, the end cap(s) 1 material can be a plastic of polyethylene, polycarbonate, acrylic, acrylonitrile-butadiene-styrene, or any other suitable translucent plastic. In some embodiments, the end caps contain fastener apertures 2, which is configured to accept a threaded spindle 13. Fastener apertures 2 maybe threaded or unthreaded. Unthreaded fastener apertures 2 allow the multiple components of the device to be connected in a multitude of options. The threaded spindle 13 maybe a bolt type, screw type, stud type, or any other suitable fastener. In some embodiments, a connecting tubular silicone material (a continuous inner tube; "rubber") can be laced through the end cap hole 3 and inverted at the end(s) to be fitted or tucked into the first Gap 5 around the end cap hole 3. Once the rubber is tucked into the first Gap 5, the end cap and tube face 11 can be fastened together to secure the rubber in place. In some embodiments, the rubber 12 binds the outer tubes 8/9 and end caps to one another as seen in FIG. 2. The rubber material 12 can be, for example, a silicone type, natural type, nitrile type, or any other suitable elastic rubber material.

The outer tube(s) 8/9 as in FIG. 1 and FIG. 2 can act as handles and a casing for the electronic components held on the hollow inside of the tube 8/9. In some embodiments the outside of the outer tube 8/9 may be knurled or smooth for varying textures and difficulties when playing with the toy. In some embodiments the entirety of the outside of the outer tube 8/9 is smooth. This allows for the toy to slide in the hand easily. In some embodiments, there is a smooth connection line between the male half of the outer tube 9 and the female half of the outer tube 8. In some embodiments, the materials of the outer tube 8/9 produces suitable low friction surface. In some embodiments, the outer tubes are white with a black dot or oval 14, covering the outermost side of the outer tube 8/9. In some embodiments, a half dome or half oval covers the male half 9 and female half 8 on each half of the tube. Different patterns and/or different colors may be used on the outer tubes 8/9 and/or dot 14. in some embodiments, this pattern indicates to the users where they should hold on to the toy when using it.

Figure 6:
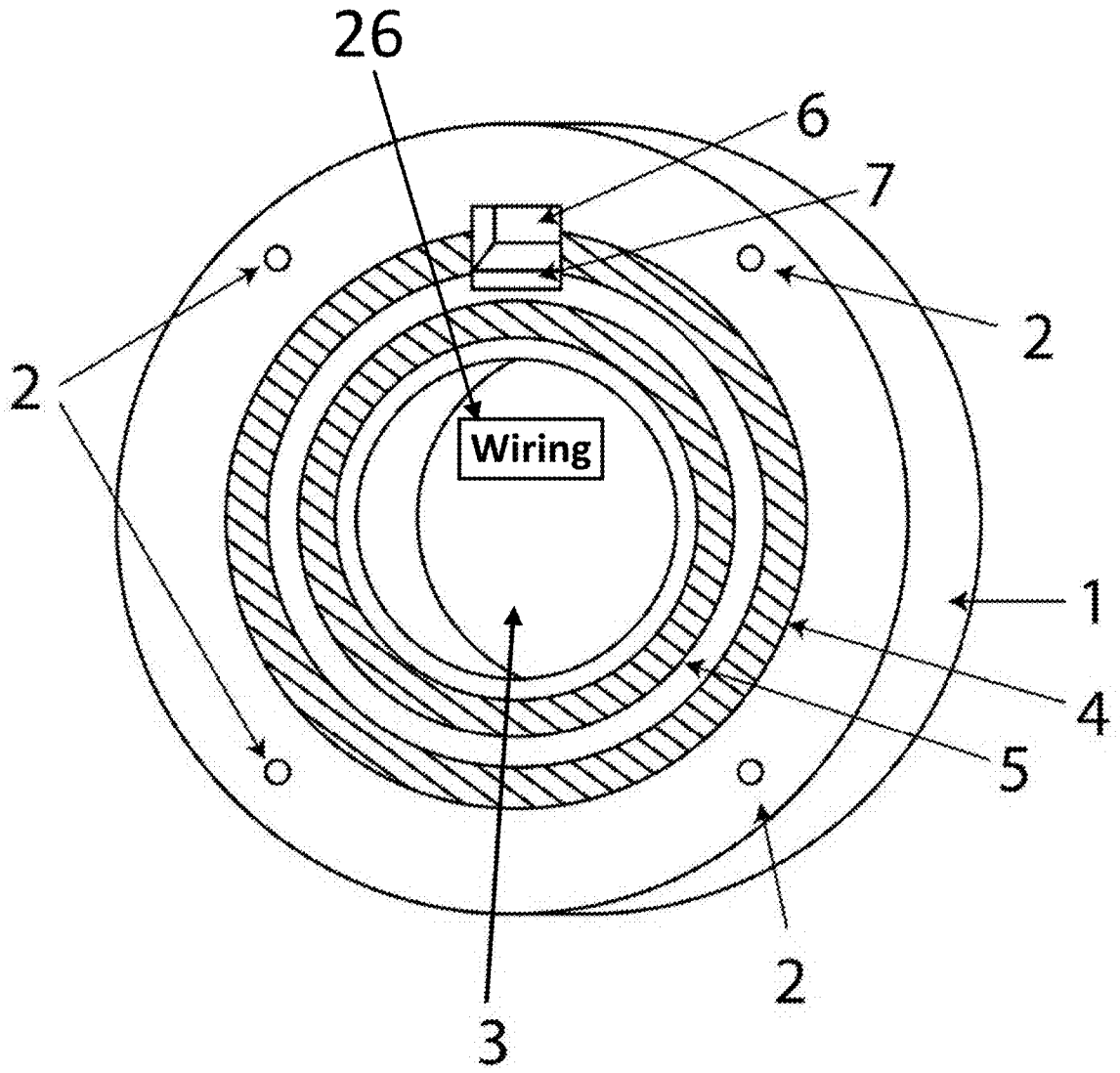
FIG. 6-FIG. 6 shows an enlarged view of the back of an example of the translucent end cap(s) of the electronic toy according to various embodiments.
Figure 7:
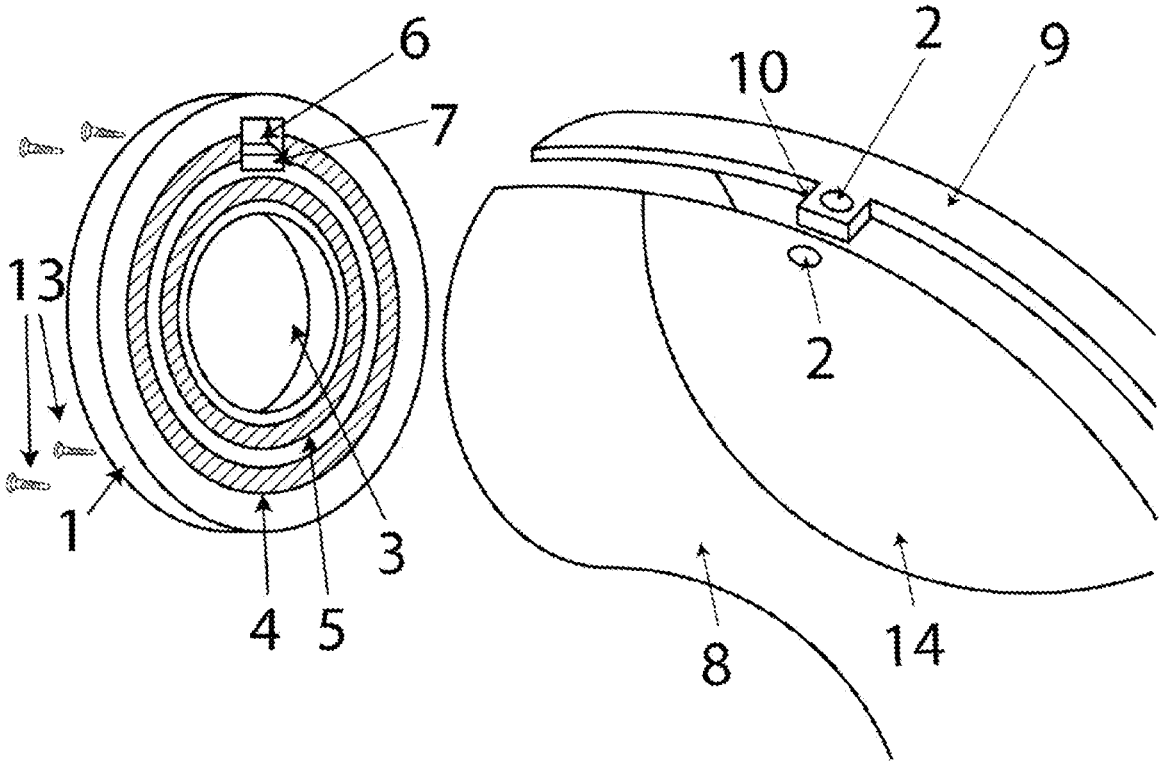
FIG. 7-FIG. 7 depicts and exploded perspective from the back of one example of the electronic toy according to various embodiments.

The end cap(s) 1 as seen in FIG. 4 and FIG. 6 may act as a part of the outer tube 8/9 to complete the handle, as seen in FIG. 1 and FIG. 2. In some embodiments, the end cap(s) contains one or more electrical components, such as the light source, light tube, sensor, printed circuit board, and/or a speaker. In some embodiments, end cap 1 acts as the securing aperture for the rubber binding between the outer tubes. The end cap 1, once fastened in place to one end of the outer tube 8/9, can then secure the end of the outer tube

8/9, but can also complete the outer tube 8/9 in its entirety. The end cap 1 can be, for example, translucent, either clear or colored, and allow for the light emitted to be viewed from the exterior of the end cap 1, but can also secure the light electronics in place.

Figures 4A, 4B, 4C:
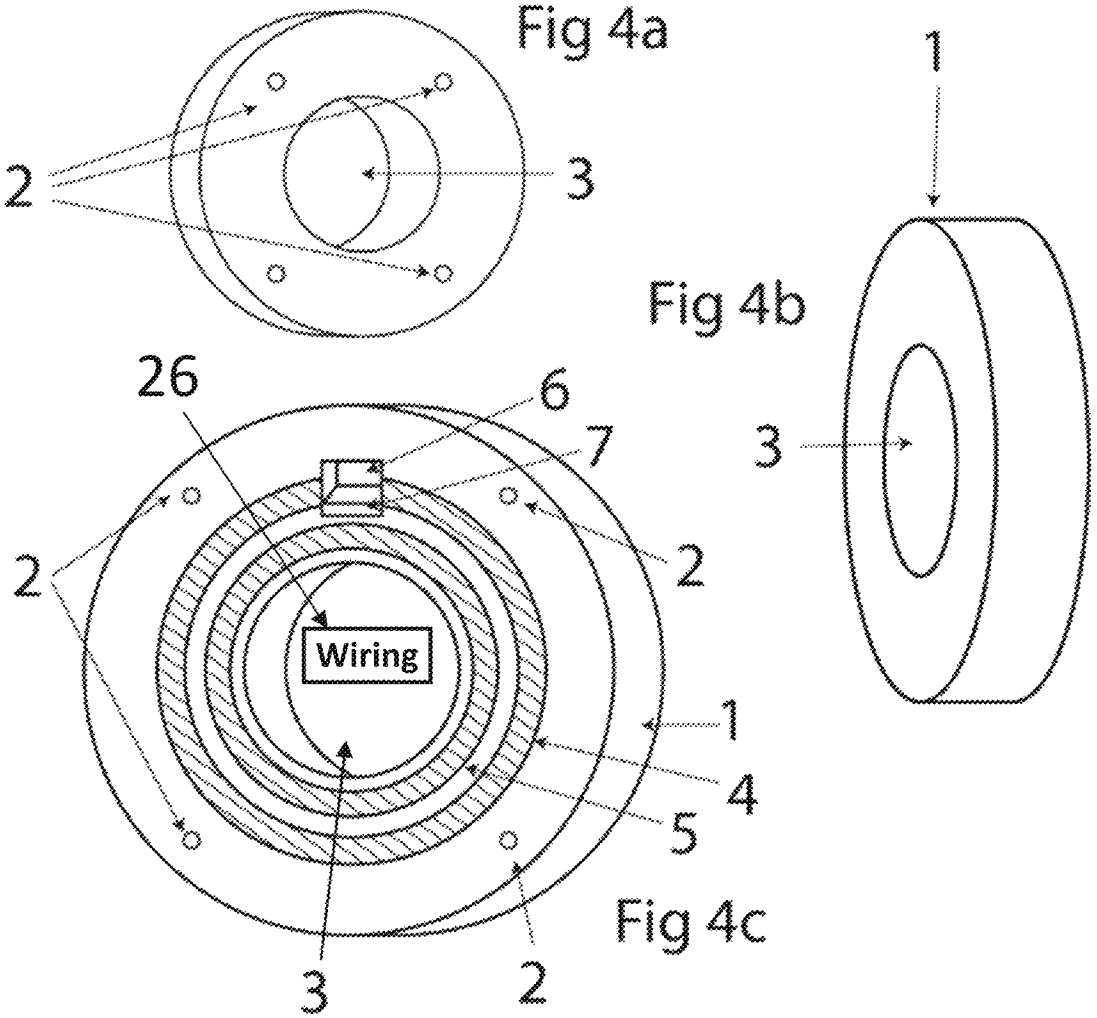
FIG. 4*a* illustrates a front view of one example of the translucent in caps of the electronic toy according to various embodiments.
FIG. 4*b* illustrates an example of a side profile view of a translucent end cap of the outer tube of the electronic toy shown in FIG. 4*a*.
FIG. 4*c* illustrates a rear view of one example of the translucent end caps of the electronic toy shown in FIGS. 4*a* and 4*b*.
Figure 5B:
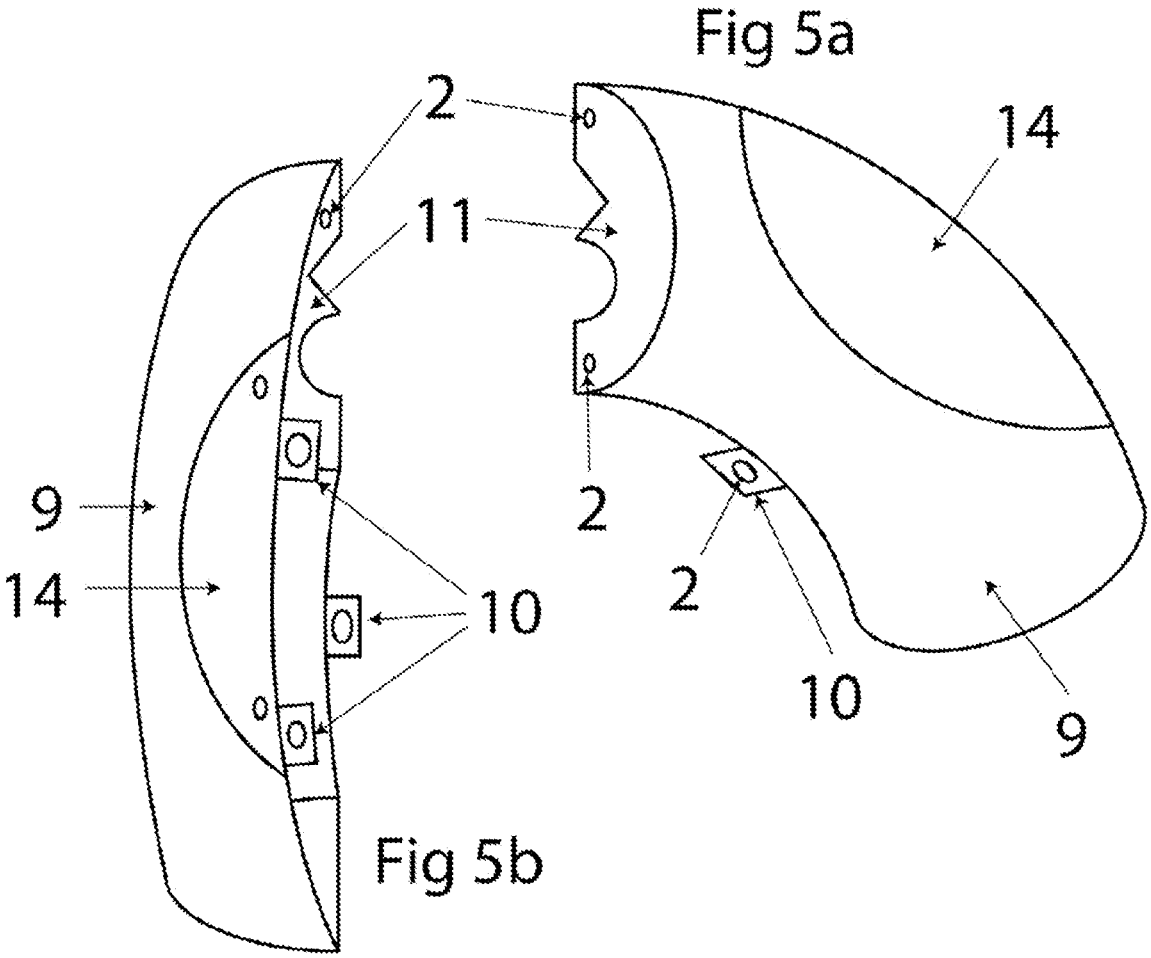
FIG. 5*b* illustrates a perspective view of the inside of the male half of the outer tube without the translucent end cap according to various embodiments.

The light source may be a light emitting diode (LED), bulb or any other suitable light source. This light source can be secured, for example, in the back of the end cap 1 as seen in FIG. 4*c* or FIG. 6. In some embodiments, the light source is secured in the light aperture 7. In some embodiments the sensor aperture 6 is located directly above the light aperture 7. In some embodiments, each end cap may contain electrical wiring 26 that connects the sensor to the light source. In some embodiments, the sensor aperture 6 is where the sensor that detects if the rubber 12 has been pulled apart the correct distance by the user. In some implementations, the joint is stretched by about five eighths of an inch for the light source to become activated. Once activated, the light source may flash or it may remain illuminated continuously. If flashing (or blinking), the light source may alternate between being illuminated, for example, for 200 ms and not illuminated for 200 ms. If flashing, the light source may flash, for example, at a rate of 2.5 flashes per second.

In some embodiments, the joint is stretched by about three quarters of an inch for the light source to become activated. In some implementations, the joint is stretched by about seven eighths of an inch for the light source to become activated. The sensor can be, for example, a hall sensor, button sensor, proximity sensor, microswitch, or any other suitable sensor. In some implementations, a light tube aperture 4 is connected to the light aperture 7. A light tube may be put into this light tube aperture 4, in order to throw light around the end cap more efficiently. In some embodiments, the light tube aperture 4 contains the light tube which runs the length of the light tube aperture 4, then through the rubber aperture 3, to the end cap directly across, attached to the same rubber material, and around that opposing end cap 1 light tube aperture 4. This allows one light source to light up two end caps and the rubber material.

In some embodiments, one or more of the outer tubes contain a speaker. The speaker may be connected to a processor, such as a printer circuit board.

The toy as seen from FIG. 1 to FIG. 2 is performing the intended action. In some embodiments, the light source for each of the end caps 1 that touch (the joint) as seen in FIG. 1 will have their own fixed or assigned color. Each of the six joints can be assigned a color that is emitted once the toy is activated. In some embodiments, a first light source is activated by any two outer tubes from the at least six outer tubes being pulled apart and a joint from the at least six joints being stretched. The toy is now switched on and ready for game play. The activation of the toy may be indicated by flashing of the first light source. In some embodiments, the gameplay will begin with the user pulling apart one of the joints to activate/turn on the toy. In some embodiments, once the toy is activated, a light sequence (light show) will begin signaling to the players the toy is on. In some implementations, the toy emits a sound (e.g., the word "start or similar) to indicate the toy is on and ready for use. In some embodiments, the light show will be presented when the joints that emit the primary colors flashes three times in consecutively. In some embodiments, the first pull/stretch will engage the first mode of play (mode one).

In mode one, the joints may light up randomly, in a slow succession from one another. Once activated, the light source may flash or it may remain illuminated continuously. If flashing (or blinking), the light source may alternate between being illuminated, for example, for 200 ms and not illuminated for 200 ms. If flashing, the light source may flash, for example, at a rate of 2.5 flashes per second.

In some embodiments, once a first light source is activated by stretching detected by a sensor, a subsequent activation of the sensor results in the first light source becoming deactivated. In some embodiments, once the toy is activated, the light sources become activated one at a time in randomized order at increasing frequency. Once all light sources are activated, the game is over.

In some embodiments, the light sources are deactivated by pulling apart the outer tubes adjacent to the light source before the subsequent light source emits light, i.e., the joints, once lit, do not turn off until the joints are stretched due to the two outer tubes adjacent to the joint being pulled apart. In such embodiments, a light source remains activated until the end of the game if the tubes adjacent to the light source are not pulled apart before the subsequent light source emits light.

In some embodiments, once the joint lights up, simultaneously a sound will be emitted by the speaker to indicate a light source in a joint (s) turned on. In some embodiments, each joint will have an assigned sound corresponding to that joints assigned emitted light color. Once stretched apart a predefined distance, as sensed by the sensor, the light sources in the end caps making up the joint being stretched may shut off. In some embodiments, the speaker emits a sound (the off sound) to indicate to the user that the joints light has been shut off. In some embodiments, once a joint is stretched and thus shut off, it will make a sound to indicate the joint has been successfully stretched the predefined distance and the joints in caps light will simultaneously shut off as the shut off sound is made. All of the joints, for example, can have the same shut off sound. As users successfully pull apart the outer tubes, stretching the joints and thus shutting end cap lights off, the random series of light source activation can begin to increase in speed. With each successful shut-off of a light source by the stretching action (the pulling apart of the outer tubes), the light sources in the joints may activate with increasing frequency. As the sequence speeds up, joints may start to light up quickly one at a time. In some embodiments, the player loses once five of the six joints light up at one time. In some embodiments of game play, the player eliminates lights quickly enough to keep no more than four joints lit at one time or else the game ends. In some embodiments, players may stretch more than one joint at a time and continue to play until they are unable to keep less than five joints activated. The toy can flash, make sounds, use language or any other suitable way of explanation to present to the user the score that was reached. The score may be determined by what level the user has reached. In some implementations, the user advances one level after stretching six joints. For example, after stretching six joints to shut off six light source, the user may reach level one, after stretching twelve joints to shut off twelve light sources, the user may reach level 2, etc. In some embodiments, a voice will tell the user their score. In some embodiments, after the score has been revealed, the shutting off sequence will begin. The shutting down sequence, directly after the score announcement, can have, for example, the secondary-colored joints flash their lights three times consecutively. At this point the toy will be off.

An illustrative assembly of the toy is shown in FIGS. 11A-20B. As shown in these figures for this embodiment, the toy comprises two types of outer tubes, socket body tubes and pin body tubes, in equal numbers. Each socket body tube and each pin body tube may be assembled from two halves (here, the first half is referred to as the lower half and the second half is referred to as the top half).

Figure 11A:
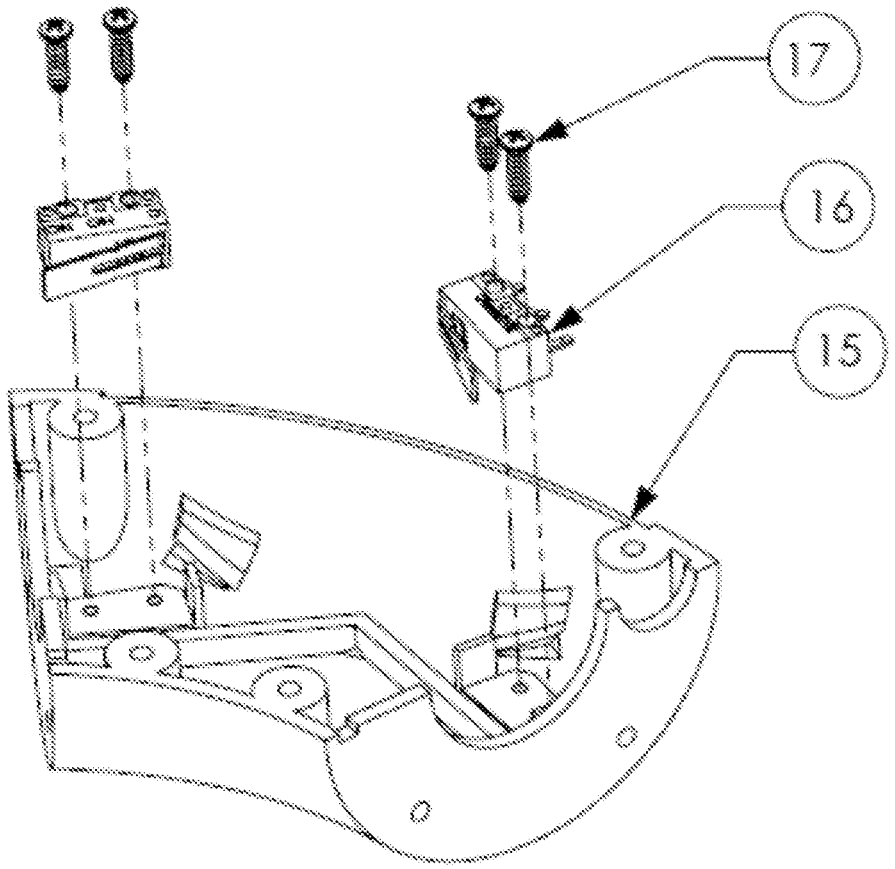
FIGS. 11A and 11B illustrate the insertion of micro unit microswitches (16), which serve as the sensors in this example, into the first half (here, the lower half) of a socket body tube (15) using screws (17), with FIG. 11A showing an overview and FIG. 11B providing detailed views of the switches' orientation.
Figure 11B:
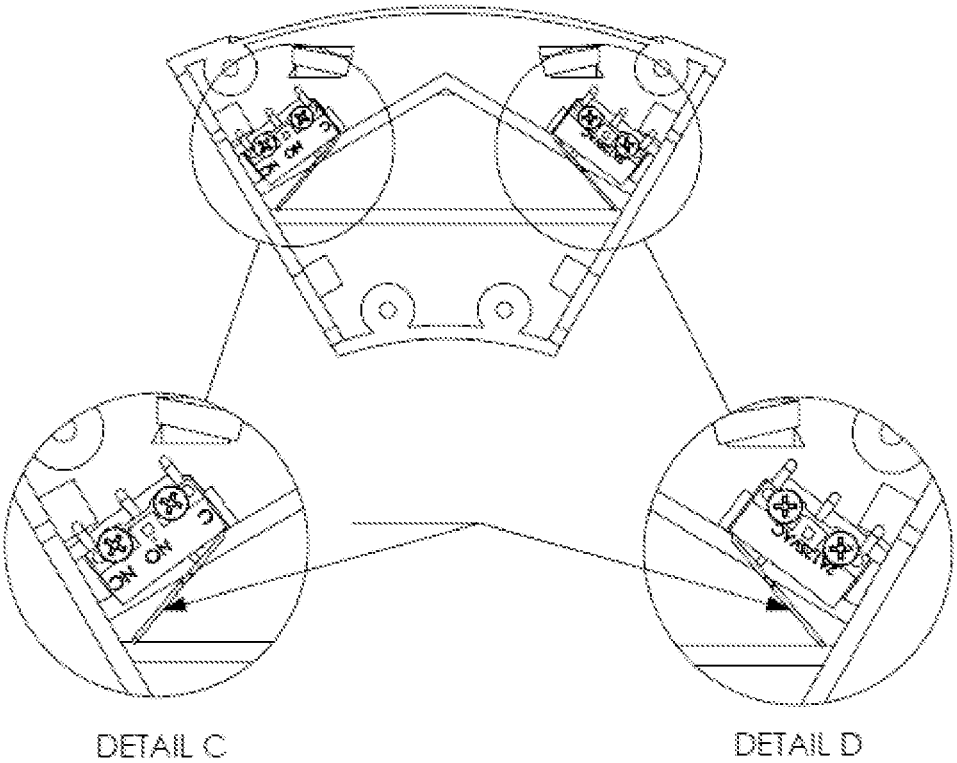

Microswitches can be used to sense (detect) the stretching of the joints as the outer tubes adjacent to the joint are pulled apart, and control the activation of the light sources in response to the joint being stretched. FIGS. 11A and 11B illustrate the insertion of microswitches (16) into a the first (in this example, the lower) half of a socket body tube (15) using screws (17), with FIG. 11A showing an overview and FIG. 11B providing detailed views of the microswitches' orientation. Shown in this example are switches with the arm biased outward, and stretching of the joint adjacent to the socket body tube containing the switch overcomes the bias, activating the switch.

Figure 12A:
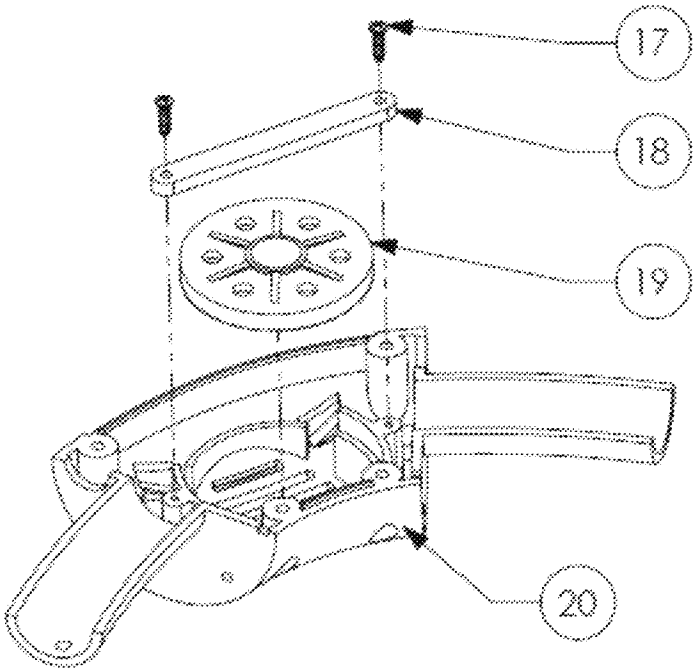
FIG. 12A shows the placement of the speaker (19) into a second half (here, the top half) of a pin body tube (20) and securing it with a backing plate (18) held in place by screws (17)
Figure 12B:
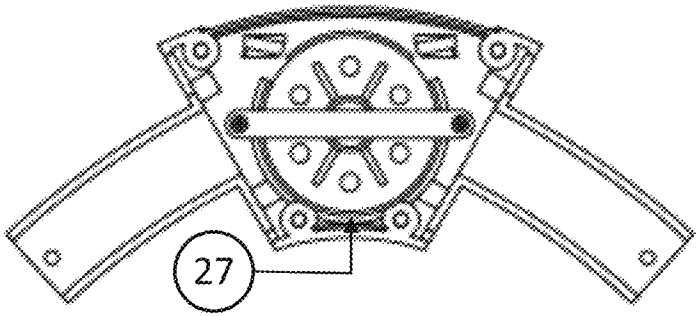
FIG. 12B shows the assembled part.
Figure 12C:
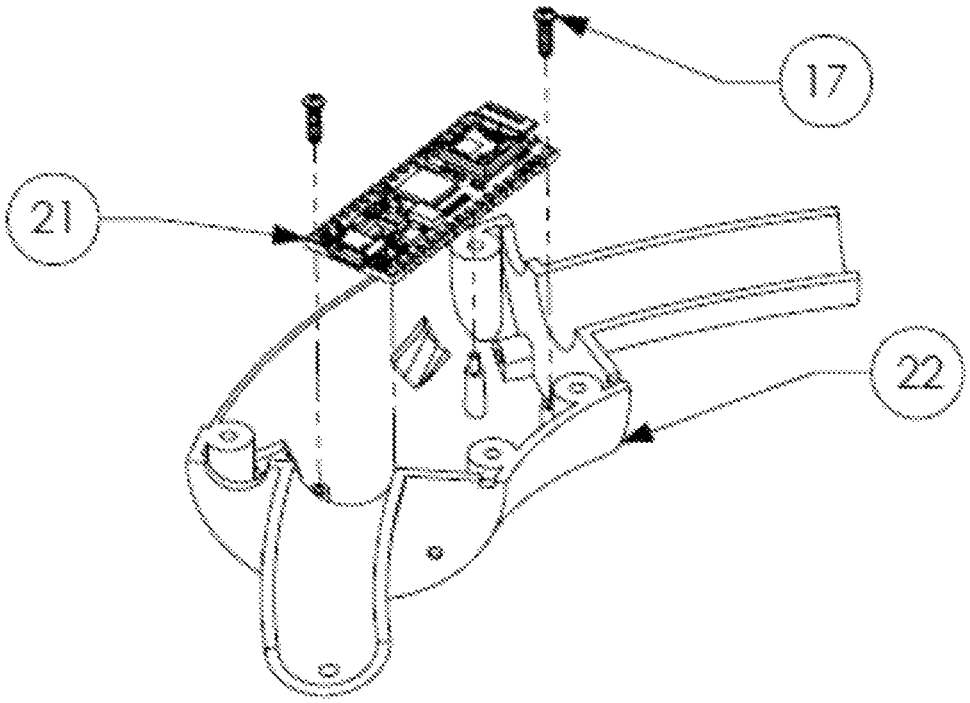
FIG. 12C shows the placement of a printed circuit board (PCB) (21) in the first half (here, the bottom half) of a pin body tube (22) with screws (17)
Figure 12D:
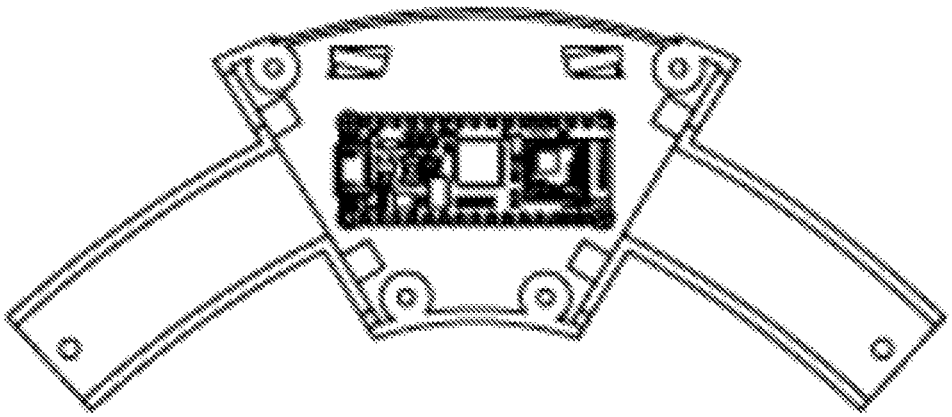
FIG. 12D shows the completed assembly.

The toy can further comprise a speaker in one or more of the outer tubes (in this example, the speaker is located in a pin body tube and coupled to a sensor). The speakers can be inserted into a pin body tube as shown in FIGS. 12A-12C. The pin body tube may be made up of two halves, numbered 20 and 22 in FIGS. 12A-12D. FIG. 12A illustrates the placement of the speaker (19) into the lower half of the pin body tube (20) and securing it with a backing plate (18) held in place by screws (17) and FIG. 12B shows the assembled lower half of the pin body tube including the speaker (19) coupled to the sensor (27). FIG. 12C illustrates the placement of a printed circuit board (PCB; 21) in the top half of the pin body tube (22) with screws (17) and FIG. 12D shows the completed assembly of the top half of the pin body tube.

Figure 13A:
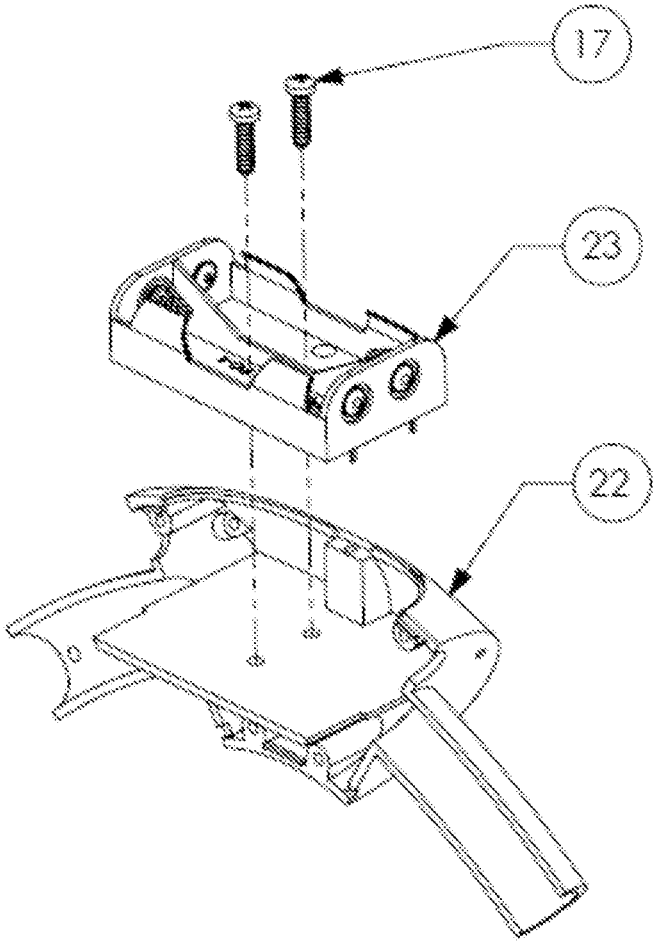
FIG. 13A illustrates the insertion of a battery holder (23) into the first half of the pin body tube (22) with screws (17).
Figure 13B:
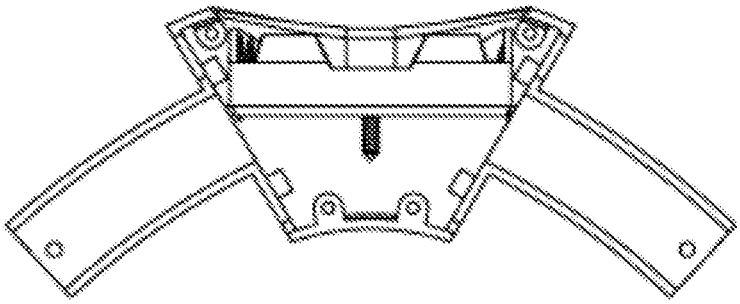
FIG. 13B shows a side view of the pin body tube with the battery holder in place.

FIG. 13A illustrates the insertion of a battery holder (23) into the lower half of the pin body tube (22) with screws (17). FIG. 13B shows a side view of the pin body tube with the battery holder in place.

Figure 14A:
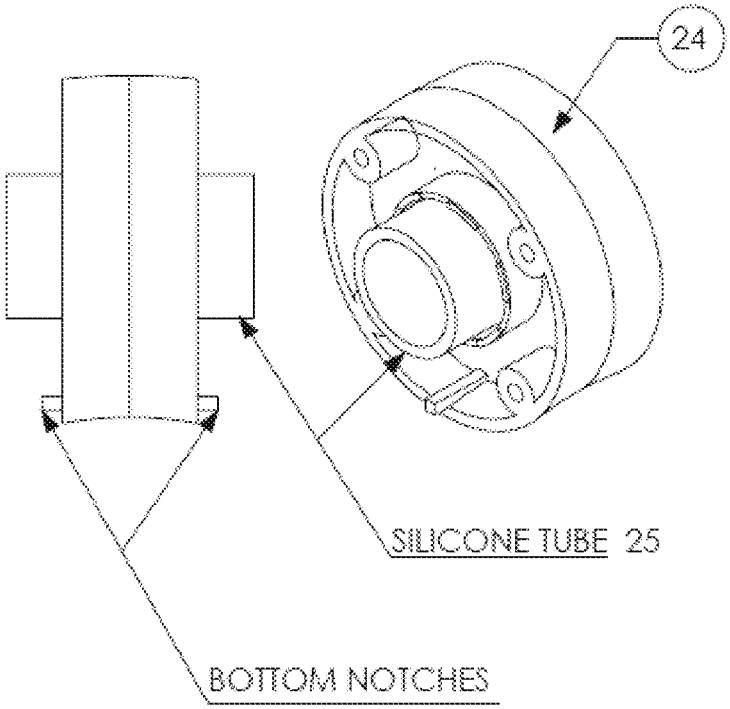
FIGS. 14A and 14B illustrate an example of how two end caps (24) are connected with a silicone tube (indicated by arrows in FIG. 14B) to form a joint.
Figure 14B:
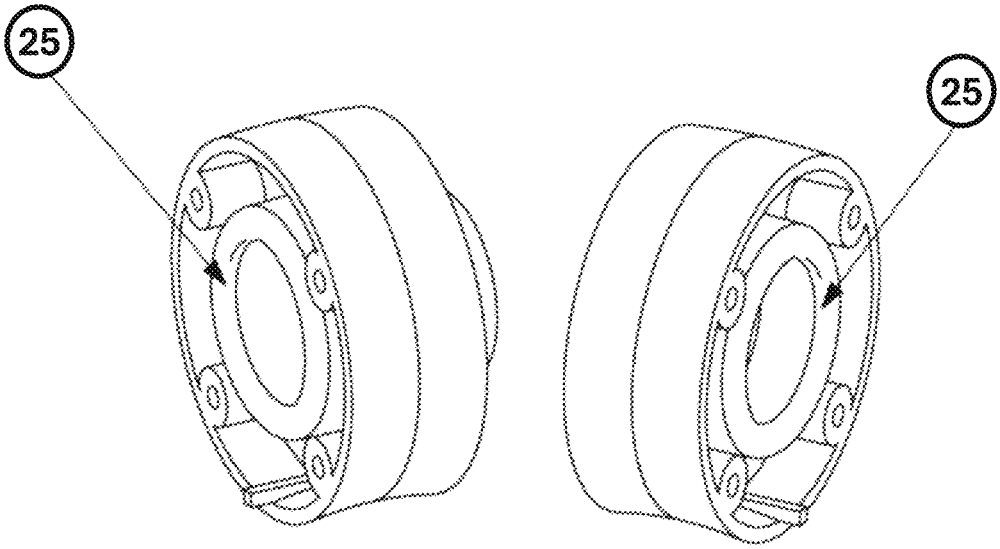

A silicone tube (in this example, cut to approximately 36.5 millimeters in length) can be used to connect two of the end caps (24) as shown in FIGS. 14A and 14B to form a joint. The bottom notches of the two end caps being connected can be aligned, and the silicone tube can then be pushed through the two end caps and the ends of the silicone tubes folded over the inside wall of the center hole of each end caps (illustrate with arrows in FIG. 14B).

Figure 15:
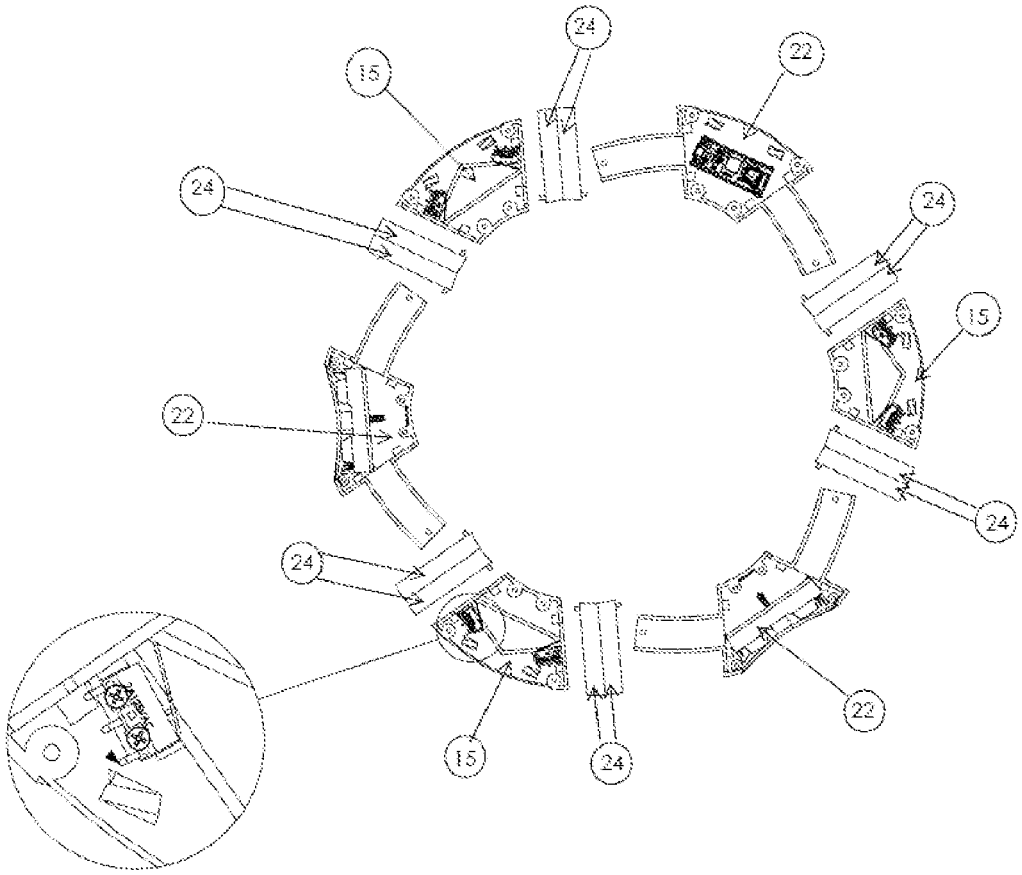
FIG. 15 shows the assembled first halves of the pin body tubes (22), the assembled first halves of the socket body tubes (15) and the connected pairs of end caps (24) laid out in their correct order and orientation but not yet connected.

The lower halves of the pin body tubes, lower halves of the socket body tubes, and the paired end caps (or joints) can then be laid out as shown in FIG. 15, and the wires connecting the sensors (e.g., microswitches) and light sources can be run through each part and though each hole in the end caps. In this example, the pins of the lever switches can be soldered and then folded flat to avoid contact with the top cap latch.

Figure 16A:
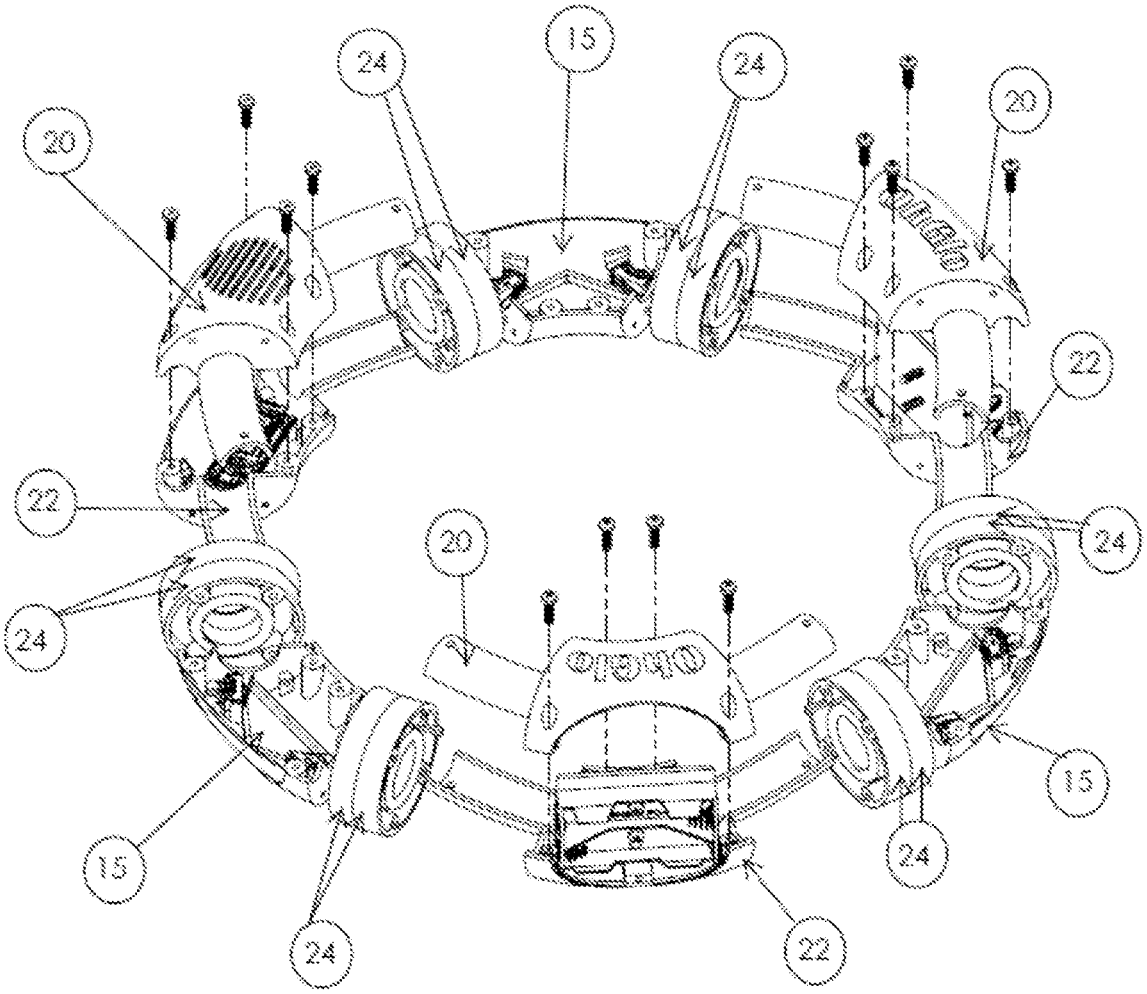
FIG. 16A shows how the second halves of the pin body tubes (20) are fitted onto the first halves of the pin body tubes (22) and secured in place with screws.
Figure 16B:
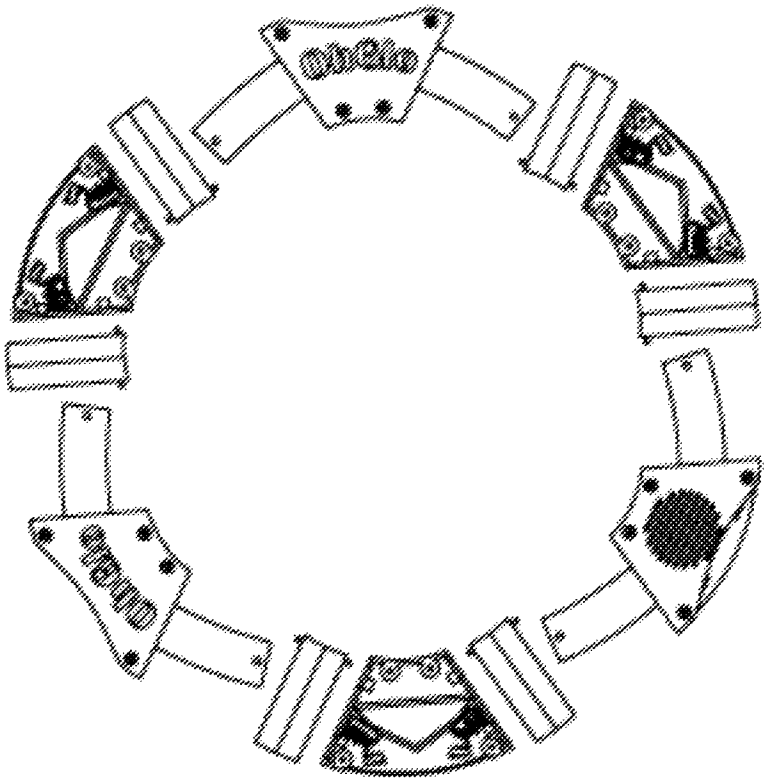
FIG. 16B shows an exploded top view of the assembled pin body tubes, first halves of the socket body tubes and paired end caps in their correct order and orientation but not yet connected.

Once all wiring connections are made, the top halves of the pin body tubes (20) may be fitted as shown in FIG. 16A and secured in place with screws. FIG. 16B shows an exploded top view of the lower halves of the socket body tubes, the assembled pin body tubes and the paired end caps in their correct orientation but not yet connected.

Figure 17A:
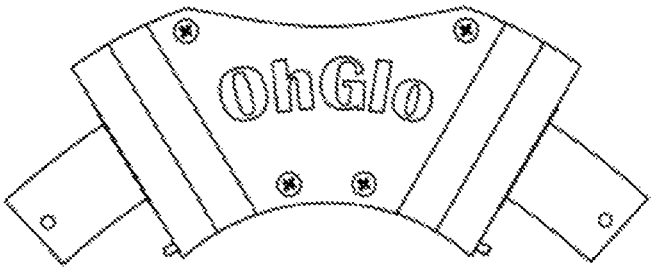
FIG. 17A illustrates the connection of an end cap to a pin body tube.
Figure 17B:
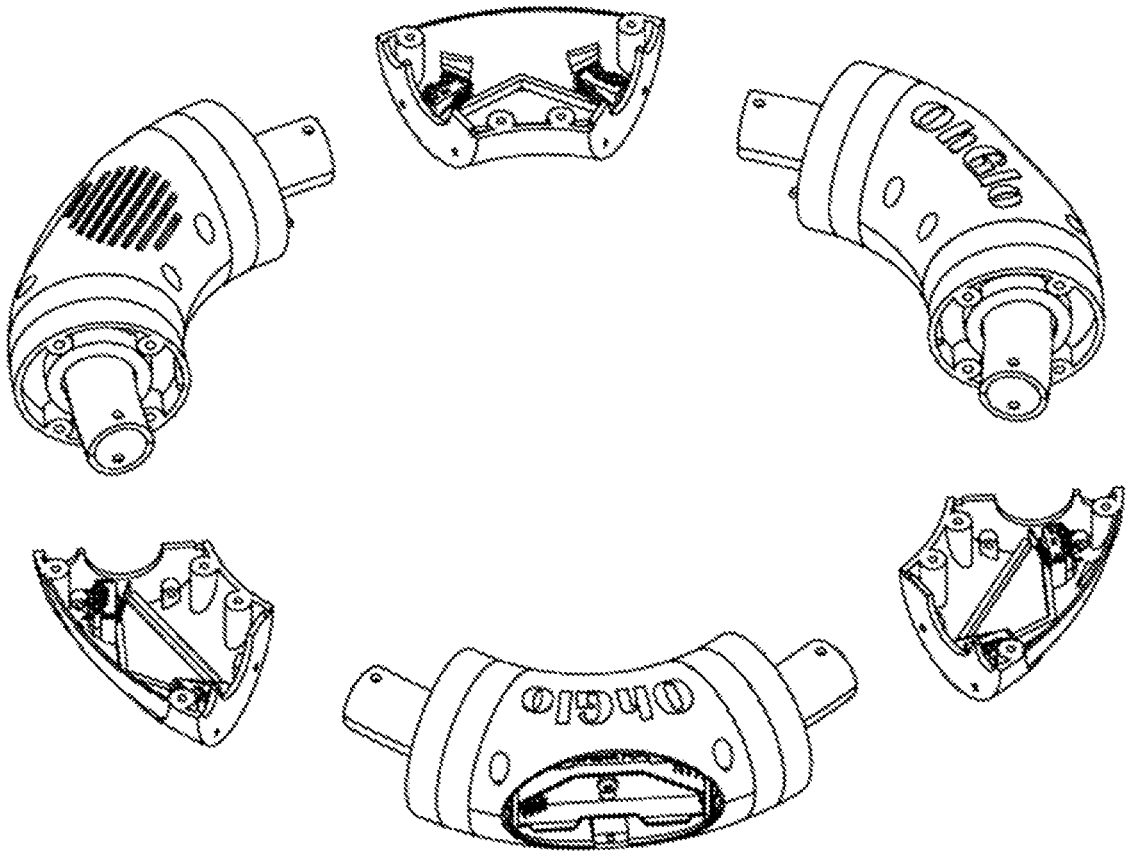
FIG. 17B shows an exploded view of the assembled pin body tubes with the end caps attached and the first halves of the socket body tubes in their correct order and orientation.

To connect the parts, the joints (with the silicone over the edges) can be slid onto the pin body tubes as shown in FIG. 17A and the joints may be secured to each body piece with screws. FIG. 17B shows an exploded view of the pin body tubes with the joints attached and the lower halves of the socket body tubes in their correct orientation.

Figure 18A:
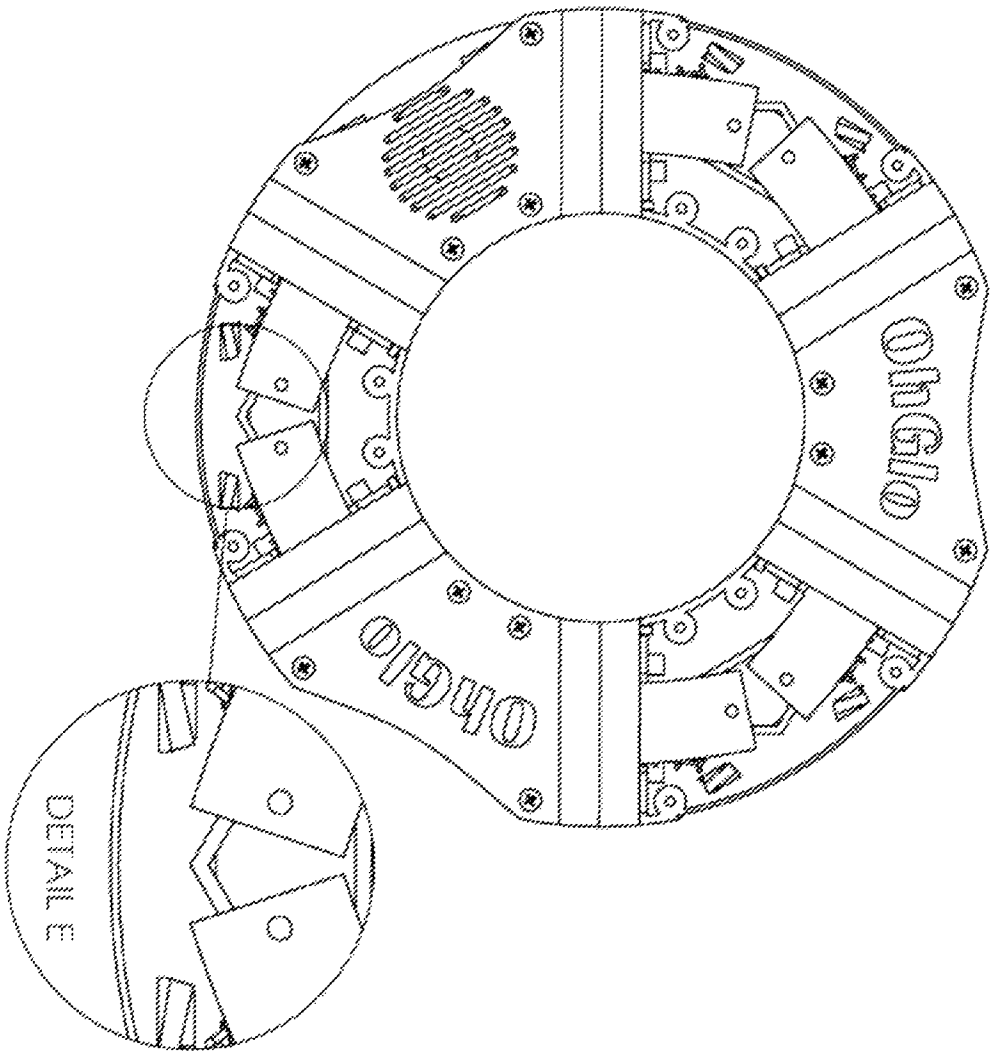
FIG. 18A illustrates how the assembled pin body tubes with the end caps attached can be connected to the first halves of the socket body tubes.
Figure 18B:
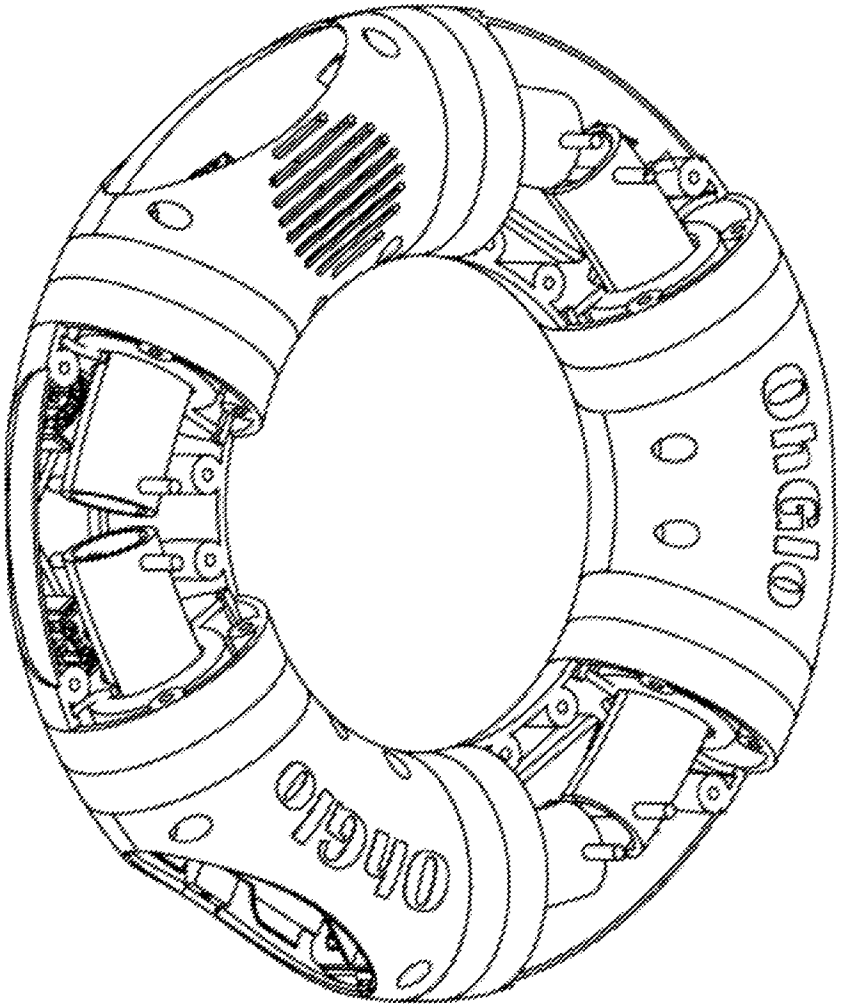
FIG. 18B illustrates how pins are used to secure the pin body tubes in the socket body tubes.

The pin body tubes with the joints attached and the lower halves of the socket body tubes may then be pushed together as illustrated in FIG. 18A, avoiding the trapping of any wires. At least about 55 mm of wires should be looped inside each outer tube (between the ends of two adjacent pin body tube, see Detail E of FIG. 18A) to ensure that no wire is tugged if the outer tubes are pulled apart during game play. Pins are pushed through each pin body tube as shown in FIG. 18B.

Figure 19A:
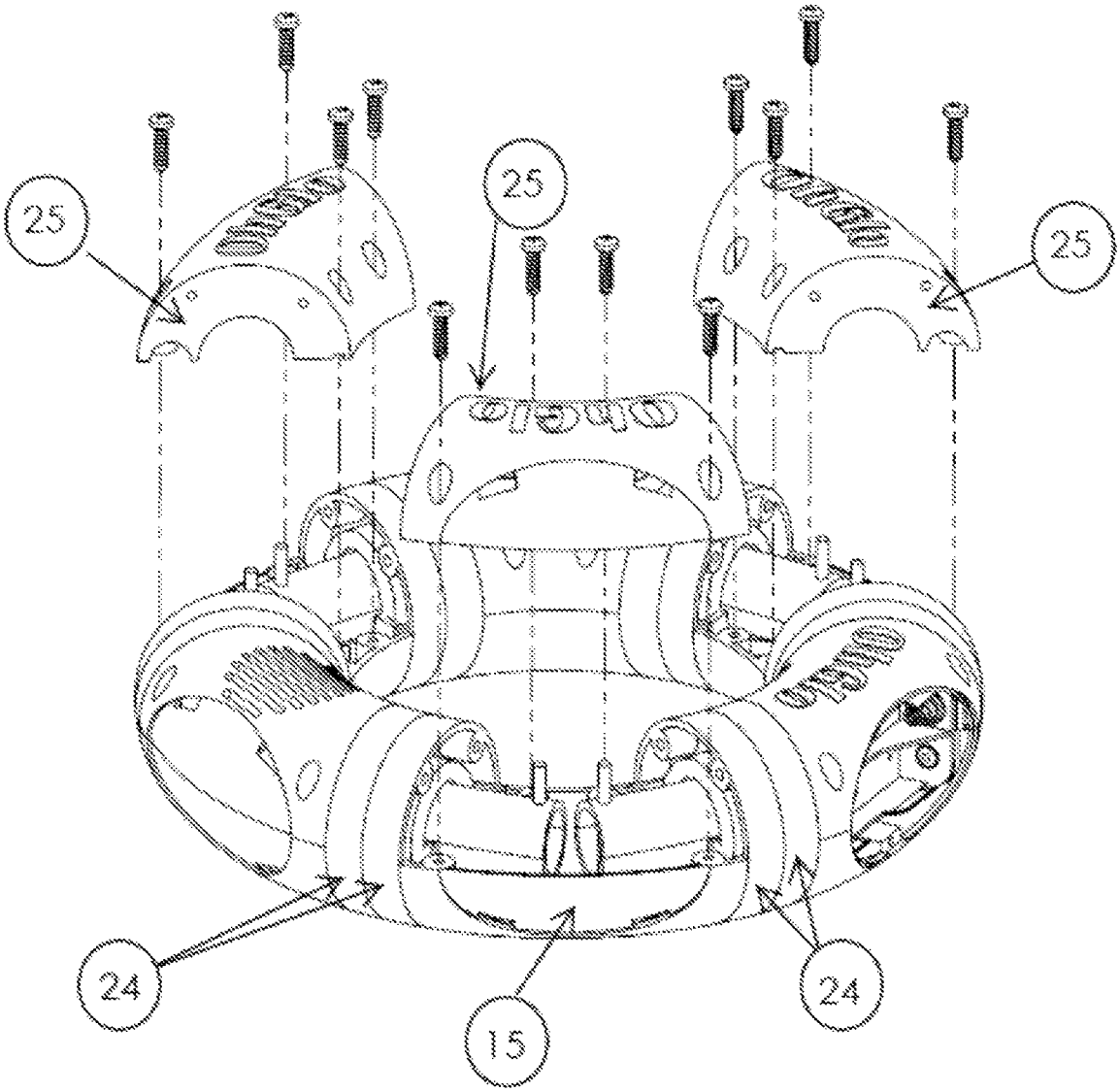
FIG. 19A illustrates how the second halves (here, top halves) of the socket body tubes (25) are fitted and secured onto the first halves of the socket body tubes (15)
Figure 19B:
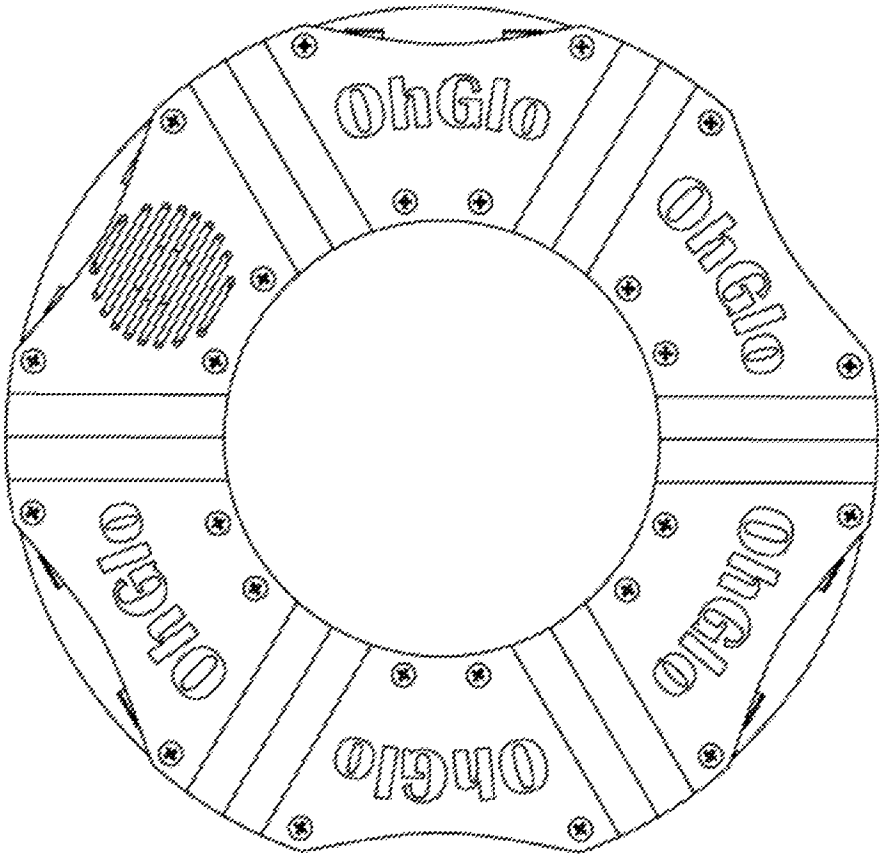
FIG. 19B shows a top view of the completed assembly.

Once all electrical connections are made, the top halves of the socket body tubes (25) may be screwed into place as shown in FIG. 19A. FIG. 19B shows a top view of the connected socket body tubes, pin body tubes and joints.

Figure 20A:
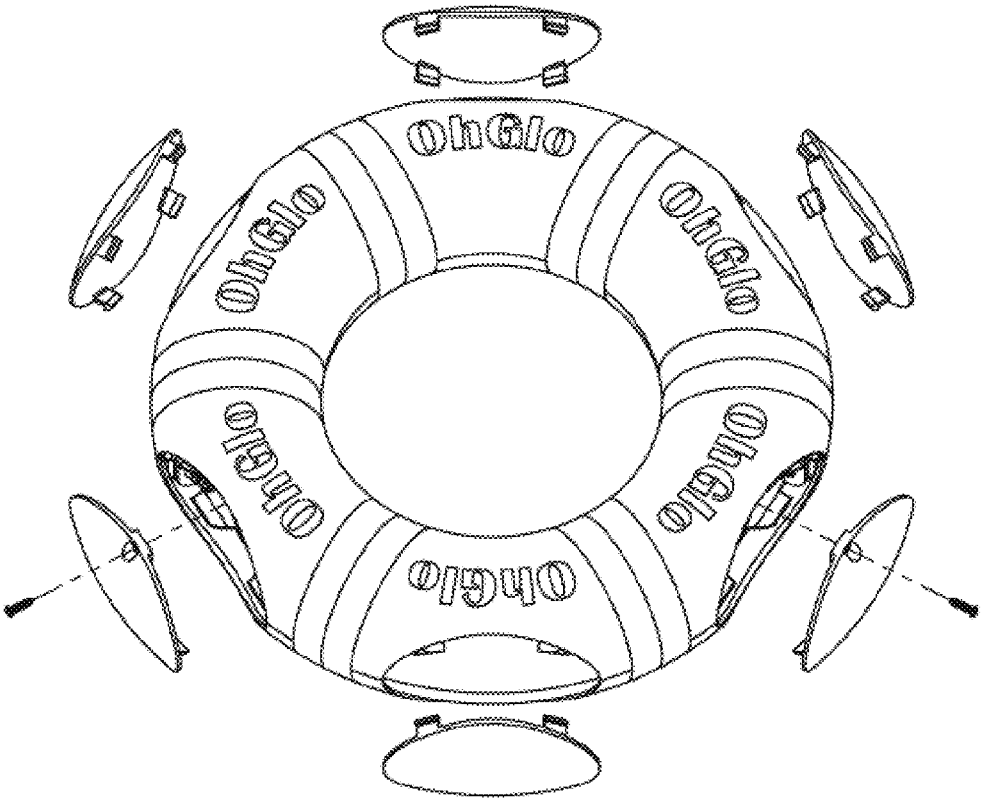
FIG. 20A shows how the six top caps are fitted into place and FIG. 20B shows the assembled toy.
Figure 20B:
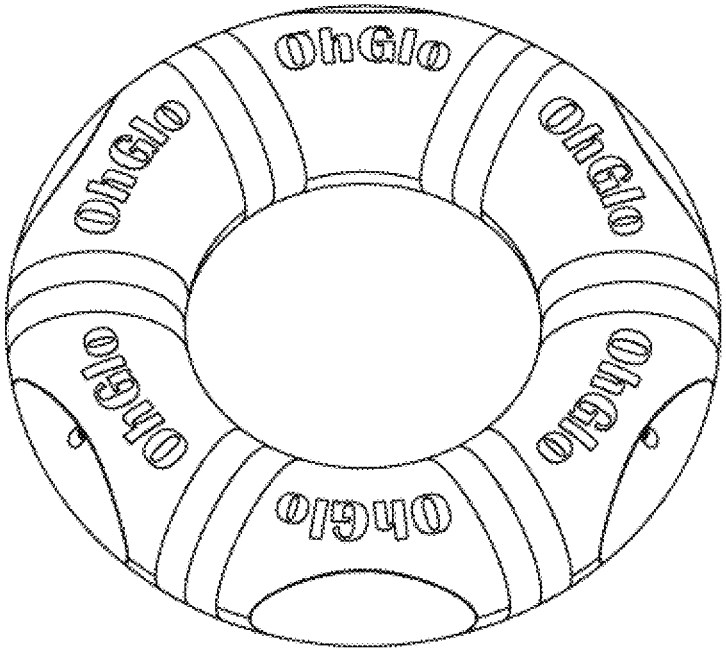

Lastly, the six top caps may be fitted into place as shown in FIG. 20A. The top caps may be added to give the toy a substantially taurus shape and allow for access to the battery compartments. The top caps covering the battery compartments may be screwed into place, while the other four top caps may simply be pushed in. FIG. 20B shows the assembled toy.

Methods of Use

In another aspect, provided herein is a method, comprising:

pulling apart a first pair of outer tubes from a plurality of outer tubes, the first pair of outer tubes being adjacent to a joint comprising two end caps, the joint containing a first light source, to cause the joint connecting the first pair of outer tubes to stretch and to cause the first light source to be activated;

pulling apart a second pair of outer tubes from the plurality of outer tubes, the second pair of outer tubes being adjacent to the joint having the first light source, before a second light source becomes activated, to cause the first light source to be deactivated;

allowing time for the second light source to become activated; and pulling apart a third pair of outer tubes from the plurality of outer tubes adjacent to a joint containing the second light source, before a third light source becomes activated, to cause the second light source to be deactivated. The pairs of outer tubes can comprise any two of the outer tubes in the plurality of outer tubes, i.e., a given outer tube can be included in at least two different pairs of outer tubes.

In some embodiments, the plurality of outer tubes includes at least three, at least four, at least five, or at least six outer tubes. In some embodiments, the stretching of the joint is detected by a microswitch.

In some embodiments, the second light source only becomes deactivated if the tubes adjacent to the second light source are pulled before the third light source becomes activated. If the tubes adjacent to the second light source are not pulled before the third light source becomes activated, the second light source remains activated.

The steps of allowing time for a light source to become activated and then pulling apart the two outer tubes adjacent to the light source may be repeated until five out of six light sources are activated.

In another aspect, provided herein is a method, comprising:

activating a first light source from a plurality of light sources in response to a joint from a plurality of joints being stretched as a pair of outer tubes from a plurality of outer tubes are pulled apart;

deactivating, after the activating, the first light source in response to a pair of outer tubes from the plurality of outer tubes and adjacent to the joint containing the first light source being pulled apart;

activating a second light source of the plurality of light sources;

deactivating, after the activating the second light source in response to a pair of outer tubes from the plurality of outer tubes and adjacent to the joint containing the second light source being pulled apart; and repeating the activating and the deactivating until each light source from the plurality of light sources is activated, the first light source, the second light source and subsequent light sources from the plurality of light sources being activated at increasingly shorter intervals.

Figure 21:
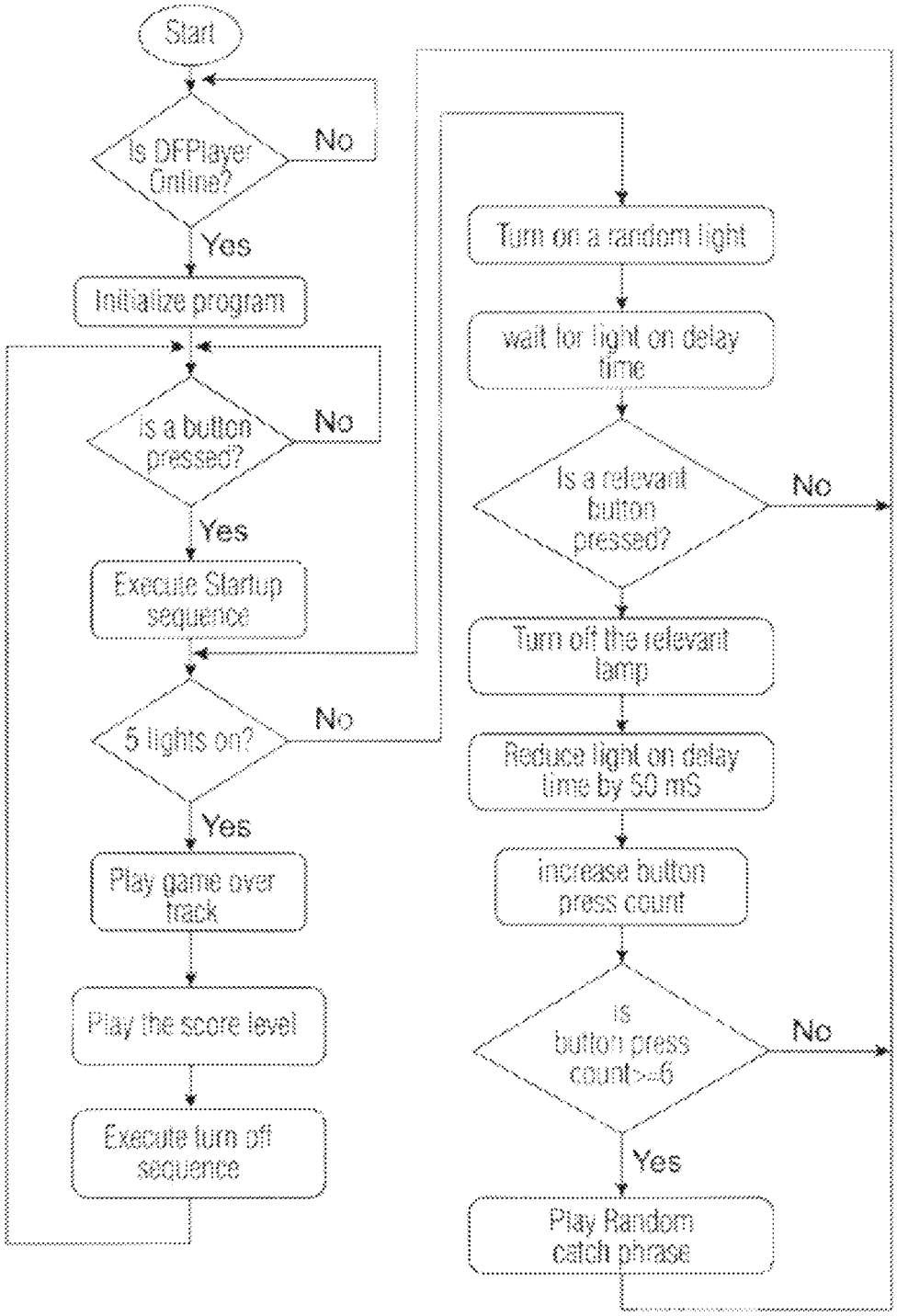
FIG. 21 is a flow chart showing the steps of activating light sources and emitting sounds controlled by software.

In some implementations, the time between activation of two light sources decreases by about 30 mS, about 35 mS, about 40 mS, about 45 mS, about 50 mS, about 55 mS, about 60 mS, about 65 mS or about 70 mS each time. In some embodiments, a sound is emitted at the same time as the light source is activated. The sound may be emitted by any suitable audio output device (e.g., a speaker) along with a processor (controller) to control output to the audio output device. Such a processor (controller) can be and/or include an MP3 player, such as a mini MP3 player (or mini MP3 player module) like a DFPlayer. The activation of the light sources and the emission of sounds may be controlled by software executed at the controller/processor (not shown) and/or stored in a memory (not shown) coupled to the controller/processor. The processor can be further coupled to the light sources and the audio output device. An illustrative process of the activation of light sources and emission of sounds is shown in FIG. 21.

The processor (controller) can be or include, for example, a hardware based integrated circuit (IC), or any other suitable processing device configured to run and/or execute a set of instructions or code. For example, the processor can be a general-purpose processor, a central processing unit (CPU), an accelerated processing unit (APU), an application specific integrated circuit (ASIC), a field programmable gate array (FPGA), a programmable logic array (PLA), a complex programmable logic device (CPLD), a programmable logic controller (PLC) and/or the like. In some implementations, the processor can be configured to run any of the methods and/or portions of methods discussed herein.

The memory can be or include, for example, a random-access memory (RAM), a memory buffer, a hard drive, a read-only memory (ROM), an erasable programmable read-only memory (EPROM), and/or the like. In some instances, the memory can store, for example, one or more software programs and/or code that can include instructions to cause the processor to perform one or more processes, functions, and/or the like. The memory can include various components (e.g., machine-readable media) including, but not limited to, a random-access memory component, a read only component, and any combinations thereof. In one example, a basic input/output system (BIOS), including basic routines that help to transfer, such as during start-up, can be stored in memory. The memory can further include any number of program modules including, for example, an operating system, one or more application programs, other program modules, program data, and any combinations thereof. For example, the process shown in FIG. 21 can be stored as a set of instructions or code in the memory, and executed by the processor.

In some implementations, the plurality of outer tubes comprises at least three, at least four, at least five, or at least six outer tubes. In some implementations, the stretching of the joint is detected by a microswitch. In some implementations, the joint is stretched by about five eighths of an inch for the light source to become activated. In some implementations, the joint is stretched by about three quarters of an inch for the light source to become activated. In some implementations, the joint is stretched by about seven eighths of an inch for the light source to become activated.

In some embodiments, the method further comprises emitting sounds as a light source becomes activated and/or as a light source becomes deactivated.

In some embodiments, two or more light sources may become activated simultaneously. In some embodiments, a sound may be emitted concurrently with the activation of a light source. The activation of the light sources and the emission of sounds may be controlled by software. Such software can be programmed to carry out the steps shown in the flow diagram in FIG. 21.

As used in this specification and the appended claims, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "about" and/or "approximately" when used in conjunction with numerical values and/or ranges generally refer to those numerical values and/or ranges near to a recited numerical value and/or range. For example, in some instances, "about 40 [units]" can mean within ±25% of 40 (e.g., from 30 to 50). In some instances, the terms "about" and "approximately" can mean within ±10% of the recited value. In other instances, the terms "about" and "approximately" can mean within ±9%, ±8%, ±7%, ±6%, ±5%, ±4%, ±3%, ±2%, ±1%, less than ±1%, or any other value or range of values therein or therebelow. The terms "about" and "approximately" may be used interchangeably. Furthermore, although a numerical value modified by the term "about" or "approximately" can allow for and/or otherwise encompass a tolerance of the stated numerical value, it is not intended to exclude the exact numerical value stated.

In a similar manner, term "substantially" when used in connection with, for example, a geometric relationship, a numerical value, and/or a range is intended to convey that the geometric relationship (or the structures described thereby), the number, and/or the range so defined is nominally the recited geometric relationship, number, and/or range. For example, two structures described herein as being "substantially non-parallel" is intended to convey that, although a non-parallel geometric relationship is desirable, some parallelism can occur in a "substantially non-parallel" arrangement. Such tolerances can result from manufacturing tolerances, measurement tolerances, and/or other practical considerations (such as, for example, minute imperfections, age of a structure so defined, a pressure or a force exerted within a system, and/or the like). As described above, a suitable tolerance can be, for example, of ±1%, ±2%, ±3%, ±4%, ±5%, ±6%, ±7%, ±8%, ±9%, ±10%, or more of the stated geometric construction, numerical value, and/or range. Furthermore, although a numerical value modified by the term "substantially" can allow for and/or otherwise encompass a tolerance of the stated numerical value, it is not intended to exclude the exact numerical value stated.

The term "processor" should be interpreted broadly to encompass a general-purpose processor, a central processing unit (CPU), a microprocessor, a digital signal processor (DSP), a controller, a microcontroller, a state machine and so forth. Under some circumstances, a "processor" can refer to an application specific integrated circuit (ASIC), a programmable logic device (PLD), a field programmable gate array (FPGA), etc. The term "processor" can refer to a combination of processing devices, e.g., a combination of a DSP and a microprocessor, multiple microprocessors, one or more microprocessors in conjunction with a DSP core or any other such configuration.

The term "memory" should be interpreted broadly to encompass any electronic component capable of storing electronic information. The term memory can refer to various types of processor-readable media such as random-access memory (RAM), read-only memory (ROM), non-volatile random-access memory (NVRAM), programmable read-only memory (PROM), erasable programmable read only memory (EPROM), electrically erasable PROM (EEPROM), flash memory, magnetic or optical data storage, registers, etc. Memory is said to be in electronic communication with a processor if the processor can read information from and/or write information to the memory. Memory that is integral to a processor is in electronic communication with the processor.

The terms "instructions" and "code" should be interpreted broadly to include any type of computer-readable statement (s). For example, the terms "instructions" and "code" can refer to one or more programs, routines, sub-routines, functions, procedures, etc. "Instructions" and "code" can comprise a single computer-readable statement or many computer-readable statements.

The specific configurations of the various components described herein can also be varied. For example, the size and specific shape of the various components can be different from the embodiments shown, while still providing the functions as described herein. Additionally, the relative size of various components of the devices shown and described herein with respect to the size of other components of the devices are not necessarily to scale.

Similarly, where methods and/or events described above indicate certain events and/or procedures occurring in certain order, the ordering of certain events and/or procedures may be modified. While the embodiments have been particularly shown and described, it will be understood that various changes in form and details may be made.

The invention claimed is:

1. An apparatus, comprising:

a hand held toy having:

a continuous inner tube;

at least two joints; and at least two outer tubes, arranged in a continuous closed loop around the continuous inner tube and connected by the at least two joints, each joint having at least two end caps, each end cap from the at least two end caps being made of a translucent elastic material, each end cap from the at least two end caps containing a light source from a plurality of light sources, the continuous inner tube containing electrical wiring that, for each end cap from the at least two end caps, connects a sensor located in the outer tube adjacent to the end cap to the light source for that end cap.

2. The apparatus of claim 1, wherein the at least two outer tubes include at least three, at least four, at least five or at least six outer tubes, connected by at least three, at least four, at least five or at least six joints from the at least two joints.

3. The apparatus of claim 2, wherein a diameter of a torus shape of the at least six outer tubes is substantially 8 inches.

4. The apparatus of claim 2, wherein a center gap of a torus shape of at least six end caps from the at least six joints is substantially 4 inches.

5. The apparatus of claim 1, wherein the continuous closed loop forms a substantially torus shape.

6. The apparatus of claim 1, wherein a first light source is activated by the at least two outer tubes being pulled apart and the joint connecting the at least two outer tubes being stretched.

7. The apparatus of claim 6, wherein a subsequent activation of the sensor results in the first light source becoming deactivated.

8. The apparatus of claim 7, wherein the sensor is activated based on a first end cap from the at least two end caps from a first joint from the at least two joints being separated from a second end cap from the at least two end caps from the first joint by a predefined distance.

9. The apparatus of claim 6, wherein once the toy is activated, the plurality of light sources become activated one at a time in randomized order at increasing frequency.

10. The apparatus of claim 6, wherein, once the toy is activated:

the plurality of light sources become activated one at a time in randomized order and at increasing frequency, the plurality of light sources are deactivated by pulling apart a first tube and a second tube of the at least two outer tubes adjacent to the light source before a subsequent light source from the plurality of light sources emits light.

11. The apparatus of claim 6, wherein, once the toy is activated:

the plurality of light sources become activated one at a time in randomized order and at increasing frequency, the plurality of light sources remain activated if a first tube and a second tube of the at least two outer tubes adjacent to the light source are not pulled apart before a subsequent light source from the plurality of light sources emits light.

12. The apparatus of claim 1, wherein, for each end cap from the at least two end caps, the light source for that end cap is a LED bulb.

13. The apparatus of claim 1, wherein each pair of end caps forming a joint from the at least two joints is made of a translucent elastic material that is different in color than each remaining pair of end caps forming a joint from the at least two joints.

14. The apparatus of claim 1, further comprising a speaker coupled to the sensor contained within an end cap from at least six end caps.

15. The apparatus of claim 14, wherein the speaker is configured to emit a sound based on/a signal received from the sensor.

16. The apparatus of claim 1, wherein each end cap from the at least two end caps defines a gap that extends there through and that is configured to receive at least a portion of the continuous inner tube such that the end cap secures a position of the continuous inner tube within the gap.

17. The apparatus of claim 1, wherein the continuous inner tube includes a rubber material.

18. The apparatus of claim 1, wherein for each end cap from the at least two end caps forming a joint from the at least two joints:

that end cap includes a first face and a second face opposite the first face, the first face of that end cap is configured to fasten to an outer tube from the at least two outer tubes, the second face of that end cap is configured to contact a face of a remaining end cap from the at least two end caps.

19. The apparatus of claim 1, wherein the continuous inner tube is configured to transition between a stretched configuration and an unstretched configuration.

20. The apparatus of claim 19, wherein the sensor is configured to detect transitions between the stretched configuration and the unstretched configuration.

* * * * *